US005610356A

United States Patent [19]

Koseki et al.

[11] Patent Number: 5,610,356

[45] Date of Patent: Mar. 11, 1997

[54] KEYBOARD MUSICAL INSTRUMENT HAVING HAMMER STOPPER EXACTLY POSITION AT BLOCKING POSITION

[75] Inventors: Shinya Koseki; Kiyoshi Kawamura, both of Shizuoka, Japan

[73] Assignee: Yamaha Corporation, Japan

[21] Appl. No.: 503,527

[22] Filed: Jul. 18, 1995

[30] Foreign Application Priority Data

Jul. 25, 1994 [JP] Japan ..... 6-172701

[51] Int. Cl.[6] ..... G10C 3/12; G10C 5/00; G10D 15/00; G10H 1/34

[52] U.S. Cl. ..... 84/719; 84/720; 84/171; 84/236; 84/423 R

[58] Field of Search ..... 84/719, 720, 2, 84/3, 171, 236–255, 423 R, 433, DIG. 7

[56] References Cited

U.S. PATENT DOCUMENTS 5,374,775 12/1994 Kawamura et al. ..... 84/615

*Primary Examiner*—Stanley J. Witkowski
*Attorney, Agent, or Firm*—Graham & James LLP

[57] ABSTRACT

A keyboard musical instrument selectively enters into an acoustic sound mode for generating acoustic piano tones and an electronic sound mode for generating electronic sounds instead of the acoustic piano tones, and a stopper is changed between a free position and a blocking position by an actuator controlled through detection with photo-interrupters, thereby eliminating aged deterioration from the position control between the free position and the blocking position.

12 Claims, 12 Drawing Sheets

KEYBOARD MUSICAL INSTRUMENT HAVING HAMMER STOPPER EXACTLY POSITION AT BLOCKING POSITION

FIELD OF THE INVENTION

This invention relates to a keyboard musical instrument and, more particularly, to a keyboard musical instrument having a hammer stopper exactly positioned at a blocking position.

DESCRIPTION OF THE RELATED ART

A typical example of the keyboard musical instrument is disclosed in U.S. Ser. No. 08/073,092 claiming the priority right on the basis of Japanese Patent Application Nos. 4-17481 3, 4-207352, 4-299234 and 5-31420, and the U.S. patent application resulted in U.S. Pat. No. 5,374,775.

The prior art keyboard musical instrument largely comprises an acoustic piano, an electronic sound generating system and a controlling system. When a player selects the acoustic tones, the controlling system changes a hammer stopper to a free position, i.e., outside of the trajectories of the hammers incorporated in the acoustic piano, and the hammers strike the strings so as to generate the acoustic tones. On the other hand, if the player selects the electronic sounds, the controlling system changes the hammer stopper to a blocking position on the trajectories of the hammers, and the hammers rebound on the hammer stopper before strikes at the strings. The electronic sound generating system monitors the keyboard, and generates electronic sounds corresponding to the acoustic tones to be generated.

A typical example of the hammer stopper is implemented by a rotatable shaft member provided with cushions and laterally extending between the strings and the hammer shanks at the home positions. The cushions project from the outer surface of the rotatable shaft member, and are opposed to the hammer shanks in the blocking position. On the other hand, while the hammer stopper is staying in the free position, the outer surface of the rotatable shaft member is opposed to the hammer shank, and the hammers strike the strings without the interruption of the hammer stopper. Thus, the hammer stopper is changed between the free position and the blocking position depending upon the selection of the player.

The hammer stopper is driven for rotation by means of a suitable driver unit. The driver unit is broken down into an electric motor associated with a controller and a link mechanism. The link mechanism is economical rather than the electronic motor system, and is, by way of example, disclosed in U.S. Pat. No. 5,386,083.

A typical example of the link mechanism includes a flexible wire extending between the complicated mechanisms of the acoustic piano, and is terminated at a foot pedal or a hand grip. When the player manipulates the foot pedal or the hand grip, the flexible wire transfers the motion of the foot pedal/hand grip to the rotatable shaft member, and changes the hammer stopper between the free position and the blocking position.

The prior art keyboard musical instrument thus arranged encounters a problem in that the hammer stopper varies the blocking position. When the hammer stopper does not reach the blocking position, the hammer stopper can not interrupt the hammers before the strikes at the strings, and the hammers softly strike the strings upon the rebound on the hammer stopper. As a result, the acoustic sounds are unintentionally generated, and the player feels the unintentional acoustic sounds noisy.

SUMMARY OF THE INVENTION

It is therefore an important object of the present invention to provide a keyboard musical instrument which is free from the unintentional acoustic sounds.

The present inventors contemplated the problem inherent in the prior art keyboard musical instrument, and noticed that a plastic deformation had taken place in a cushion member associated with the foot through repetition of the manipulation of the foot pedal. The present inventors further noticed that the flexible wire had been elongated due to the repetition of the manipulation of the foot pedal/hand grip. Nevertheless, the cushion member was indispensable for eliminating a noise from the change-over action, and the flexible wire could not be replaced with a rigid links because the available space was too narrow. For this reason, the present inventor concluded that an electric motor was better rather than the link mechanism in view of a maintenance-free product.

Although the usage of electric motor had been proposed in the aforesaid U.S. patent application No. Ser. 08/073,092, i.e., U.S. Pat. No. 5,374,775, the specification did not teach an effective positioning control technique.

To accomplish the object, the present invention proposes to detect a position of a hammer stopper in a non-contact manner.

In accordance with the present invention, there is provided a keyboard musical instrument having at least an acoustic sound mode for generating acoustic sounds and an electronic sound mode for generating electronic sounds, comprising: an acoustic piano including a keyboard having a plurality of turnable keys respectively assigned notes of a scale and selectively depressed by a player in both of the acoustic sound mode and the electronic sound mode, a plurality of string means for generating the acoustic sounds in the acoustic sound mode, a plurality of hammer assemblies respectively associated with the plurality of string means and driven for rotation for striking the plurality of string means in the acoustic sound mode, and a plurality of key action mechanisms functionally connected between the plurality of turnable keys and the plurality of hammer assemblies, respectively, and having respective jacks escaping from the plurality of hammer assemblies when the plurality of keys are depressed by the player; an electronic sound generating system for generating the electronic sounds having the notes corresponding to the keys depressed by the player in the electronic sound mode; and a silent system including a hammer stopper having an interrupter changed between a free position and a blocking position, the interrupter entering into the free position in the acoustic sound mode so as to allow the plurality of hammer assemblies to strike the plurality of string means, the interrupter entering into the blocking position in the electronic sound mode so as to cause the plurality of hammer assemblies to rebound thereon before a strike at the plurality of string means, a first actuator means responsive to an instruction of the player so as to change the hammer stopper between the free position and the blocking position, and a first position controller having a first non-contact sensor operative to detect the interrupter upon an entry into the free position and a second non-contact sensor for detecting the interrupter upon an entry into the blocking position, the first actuator means stopping the interrupter when the first non-contact sensor and the second non-contact sensor report the entry into the free position and the entry into the blocking position.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
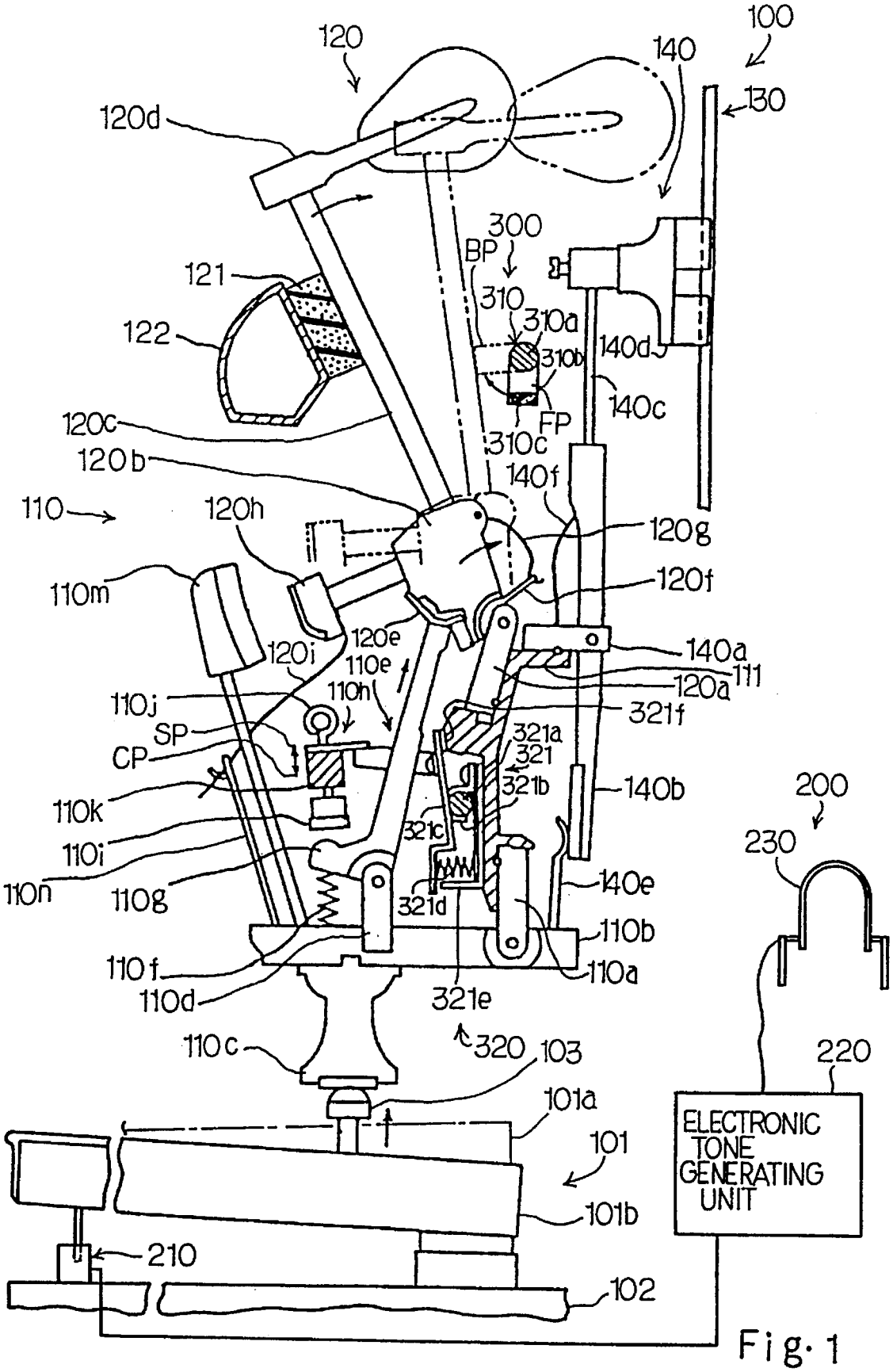
FIG. 1 is a side view showing the structure of a keyboard musical instrument according to the present invention.

Referring first to FIG. 1 of the drawings, a keyboard musical instrument embodying the present invention largely comprises an upright piano 100, an electronic sound system 200 and a silent system 300. In the following description, word "front" means a position closer to a player sitting before the upright piano for playing it, and, accordingly, a "fore-and-aft direction" extends between the front and the rear. On the other hand, a "lateral direction" is in perpendicular to the fore-and-aft direction. Terms "clockwise" and "counter clockwise" are determined on a sheet where a reference figure is illustrated.

The upright piano 100 comprises a keyboard 101, and black keys 101*a* and white keys 101*b* form the keyboard 101. Notes of a scale are respectively assigned to the black and white keys 101*a* and 101*b*, and the black and white keys 101*a* and 101*b* are turnable with respect to a key bed 102. When a player depresses the key 101*a*/101*b*, the depressed key 101*a*/101*b* turns in the counter clockwise direction, and is moved from a rest position to an end position. A capstan screw 103 is implanted into a rear portion of each of the black and white keys 101*a*/101*b*.

The upright piano 100 further comprises a plurality of key action mechanisms 110, a plurality of hammer assemblies 120, a plurality of strings 130 and a plurality of damper assemblies 140.

The plurality of key action mechanisms 110 are respectively associated with the black and white keys 101*a*/101*b*, and the plurality of key action mechanisms 110 are similar in structure to one another. The key action mechanisms 110 are supported by a center rail 111, and the center rail 111 is connected to action brackets (not shown) mounted on the key bed 102.

The key action mechanism 110 includes a whippen flange 110*a* fixed to the rear surface of the center rail 111, whippen 110*b* turnably supported by the whippen flange 110*a* and a whippen heel 110*c* attached to the bottom surface of the whippen 110*b*. The capstan screw 103 is held in contact with the whippen heel 110*c*, and the capstan screw 103 pushes the whippen heel 110*c* during the movement of the key 101*a*/101*b* from the rest position to the end position.

The key action mechanism 110 further includes a jack flange 110*d* upwardly projecting from a central portion of the whippen 110*b*, a jack 110*e* turnably connected to the jack flange 110*d* and a jack spring 110*f* provided between the toe 110*g* of the jack 110*e* and the whippen 110*b*. The jack spring 110*f* urges the jack 110*e* to turn in the clockwise direction.

The key action mechanism 110 further includes a regulating mechanism 110*h*, and the regulating mechanism 110*h* has a regulating button 110*i* opposed to the toe 110*g*, a regulating screw 110*j* screwed through a regulating rail 110*k* into the regulating button 110*i*. The regulating screw 110*j* is screwed into and out of the regulating rail 110*k*, and changes a gap between the regulating button 110*i* and the toe 110*g*.

The key action mechanism 110 further includes a back check 110*m* upwardly projecting form a front portion of the whippen 110*b* and a bridle wire 110*n* also projecting from the front end portion of the whippen 110*b*. The back check 110*m* and the bridle wire 110*n* will be hereinlater described in connection with the hammer assembly 120.

The hammer assemblies 120 are respectively associated with the plurality of key action mechanisms 110, and are similar in structure to one another. When the black and white keys 101*a*/101*b* are selectively depressed by the player, the associated key action mechanisms 110 rotate the hammer assemblies 120 in the clockwise direction, and strike the associated strings 130.

The hammer assembly 120 includes a butt flange 120*a* attached to a front surface of the center rail 111, a hammer butt 120*b* rotatably connected to the butt flange 120*a*, a hammer shank 120*c* projecting from the hammer butt 120*b* and a hammer head 120*d* attached to the hammer shank 120*c*. A butt skin 120*e* is attached to a lower surface of the hammer butt 120*b*, and the top end of the jack 110*e* is held in contact with the butt skin 120*e* while the associated key 101*a*/101*b* is staying in the rest position.

The hammer assembly 120 further includes a butt spring cord 120*f* connected to the butt flange 120*a* and a butt spring 120*g* connected between the butt spring cord 120*f* and the hammer butt 120*b*. The butt spring 120*g* urges the hammer butt 120*b* and, accordingly, the hammer shank 120*c* in the counter clockwise direction, and the hammer shank 120*c* is softly pressed against a hammer rail cloth 121 attached to a hammer rail 122. The hammer rail cloth 121 defines a home position for the hammer assembly 120.

The hammer assembly 120 further includes a catcher 120*h* projecting from the hammer butt 120*b* and a bridle tape 120*i* provided between the catcher 120*h* and the bridle wire 110*n*. As described hereinbefore, when the player depresses the key 101*a*/101*b*, the associated key action mechanism 110 rotates the hammer assembly 120 in the clockwise direction, and the hammer assembly 120 rebounds on the string 130. The catcher 120*h* is brought into contact with the back check 110*m*, and the back check 110*m* and the bridle tape 120*i* make the hammer assembly 120 quickly return to the home position.

The plurality of strings 130 are respectively associated with the black and white keys 101*a*/101*b*, and vibrate upon impacts with the hammer assemblies 120. When the hammer assemblies 120 strike the associated strings 130, the strings 130 vibrates at respective fundamental frequencies, and generate the acoustic sounds having the notes identical with the notes assigned to the associated black and white keys 101*a*/101*b*.

The plurality of damper mechanisms 140 are respectively associated with the key action mechanisms 110 and, accordingly, the black and white keys 101*a*/101*b*, and are similar in arrangement to one another. The damper assemblies 140 are held in contact with the strings 130, respectively, and leave the strings 130 in response to the key motions.

Namely, the damper mechanism 140 includes a damper lever flange 140*a* attached to the center rail 111, a damper lever 140*b* rotatably supported by the damper lever flange 140*a*, a damper wire 140*c* projecting from the damper lever 140*b*, a damper head 140*d* attached to the damper wire 140*c*, a damper spoon 140*e* implanted into the rear portion of the whippen 110*b* and a damper spring 140*f* provided between the damper lever flange 140*a* and the damper lever 140*b*. While the key 101*a*/101*b* is staying in the rest position, the damper spring 140*f* urges the damper lever 140*b* in the clockwise direction, and the damper head 140*d* is held in contact with the string 130. The damper head 140*d* prohibits the string 130 from the vibration. If the player depresses the key 101*a*/101*b*, the capstan screw 103 pushes up the whippen heel 110*c*, and the whippen 110*b* is rotated in the clockwise direction around the whippen flange 110*a*. The damper spoon 140*e* declines, and pushes the lower portion of the damper lever 140*b*. As a result, the damper lever 140*b* is rotated in the counter clockwise direction around the damper lever flange 140*a*, and the damper head 140*d* leaves the string 130. When the player releases the key 101*a*/101*b*, the whippen returns to the initial position, and the damper lever spring 140*f* urges the damper lever so that the damper head 140*d* is brought into contact with the string 130 again.

Though not shown in FIG. 1, the upright piano further comprises pedal mechanisms, i.e., a damper pedal and a soft pedal. The pedal mechanisms are similar to those of a standard upright piano, and are not described hereinbefore in detail for the sake of simplicity.

As described hereinbefore, the upright piano is a standard type, and any kind of upright piano is available for the keyboard musical instrument according to the present invention.

The electronic sound system 200 comprises a plurality of key sensors 210 for monitoring the black and white keys 101*a*/101*b*, an electronic tone generating unit 220 connected to the key sensors 210 for generating an audio signal and a headphone 230 for generating electronic sounds from the audio signal.

Each of the key sensors has a plurality of photo-interrupters and a shutter plate attached to the key 101*a*/101*b*, and reports the interruptions of the light beams of the photo-interrupters.

The electronic tone generating unit 220 is similar to the sound processing unit disclosed in U.S. Pat. No. 5,374,775, and is not described in detail.

Hammer sensors may be installed instead of the key sensors 210.

The silent system 300 comprises a hammer stopper 310 and a regulating button controller 320, and changes the keyboard musical instrument between an acoustic sound mode and an electronic sound mode. The player performs a music through the acoustic sounds in the acoustic sound mode, and can practice a fingering on the keyboard 101 without the acoustic sounds in the electronic sound mode. While the keyboard musical instrument is in the electronic sound mode, the player can listen to the music through the headphone 230.

The hammer stopper 310 includes a rotatable shaft member 310*a* laterally extending between the hammer shanks 120*c*, a plurality of bracket members 310*b* attached to the rotatable shaft member 310*a* at intervals and a plurality of cushion members 310*c* respectively attached to the bracket members 310*b*. The cushion members 310*c* attached through the bracket members 310*b* to the rotatable shaft member 310*a* are similar to the hammer stopper illustrated in FIG. 2 of U.S. Pat. No. 5,374,775, and no further description is incorporated hereinbelow.

When the player selects the electronic sound mode, the cushion members 310*c* are opposed to the hammer shanks 120*c*, and the hammer shanks 120*c* rebound on the cushion members 310*c* without a strike at the strings 130. This position is called as "blocking position" BP. On the other hand, while the player selects the acoustic sound mode, the cushion member 310*c* are downwardly directed, and the outer surface of the rotatable shaft member 310*a* is opposed to the hammer shanks 120*c*. The hammer heads 120 strike the strings without an interruption of the hammer stopper 310, and this position is called as "free position FP".

Figure 2:
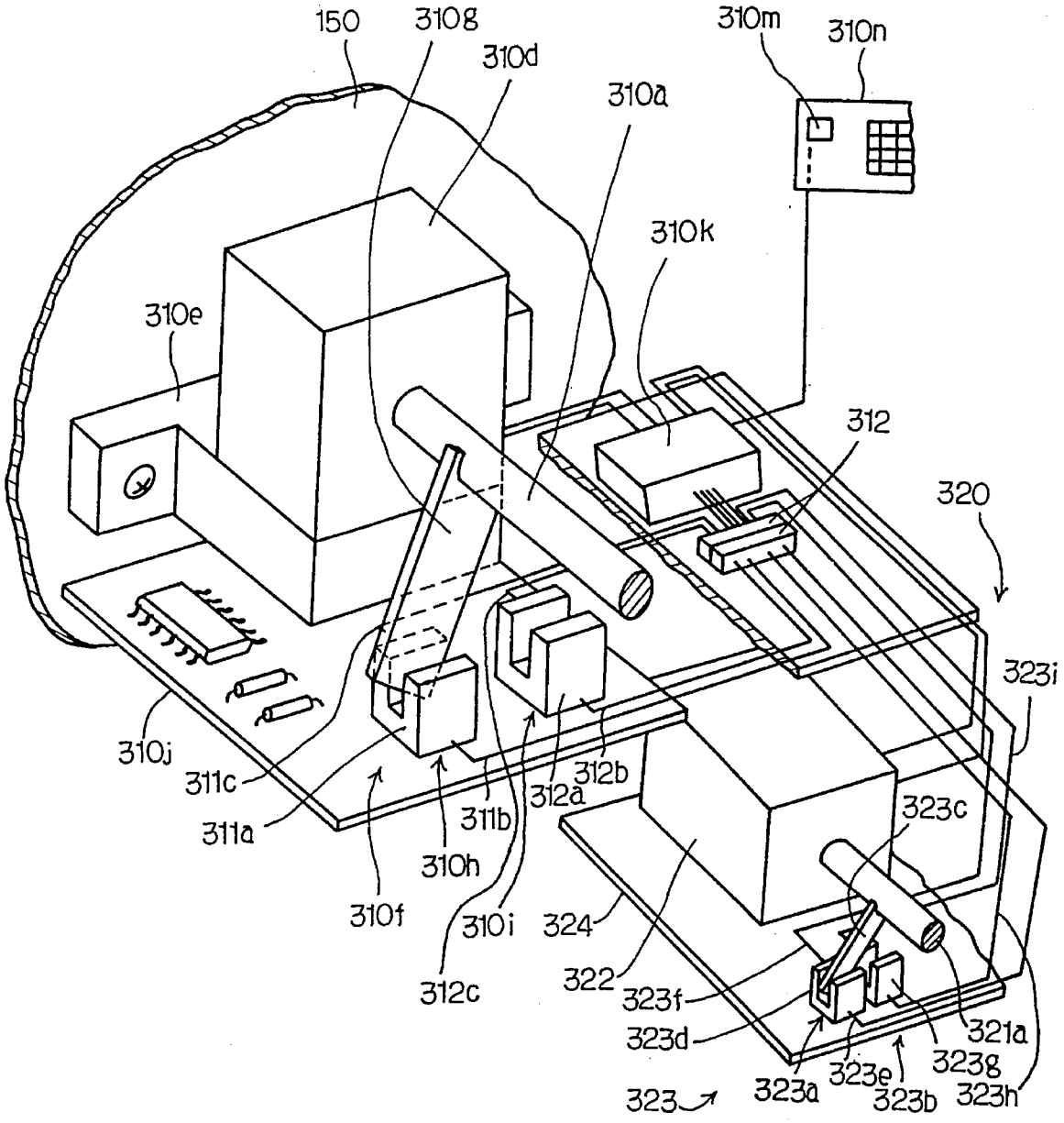
FIG. 2 is a perspective view showing an essential part of a silent system incorporated in the keyboard musical instrument according to the present invention.

The hammer stopper 310 further comprises an electric motor unit 310*d*, and the electric motor unit 310*d* is mounded on a bracket member 310*e* attached to a side board 150 of the upright piano (see FIG. 2).

The hammer stopper 310 further comprises a position controller 310*f*, and the position controller 310*f* includes a shutter plate 310*g* fixed to the rotatable shaft member 310*a*, two photo-interrupters 310*h* and 310*i* provided on a rigid board member 310*j*, a control circuit 310*k* and a push button switch 310*m*. The controlling circuit 310*k* and the push button switch 310*m* are shared with the regulating button controller 320, and the push button switch 310*m* is provided on a manipulating switch board 310*n* together with other switches provided for the electronic sound system 200. The manipulating switch board 310*n* is, by way of example, provided on an upper front board (not shown) of the upright piano 100.

When a player depresses the push button switch 310*m*, the controlling circuit 310*k* acknowledges a change of the mode, and supplies driving current to the electric motor unit 310*d*, and the rotatable shaft member 310*a* is driven for rotation in one direction. The controlling circuit 310*k* makes a decision that the cushion members 310*c* enters one of the free position FP and the blocking position BP upon a detection of the shutter plate 310*g* by means of one of the photo-interrupters 310*h* and 310*i*, and stops the driving current.

If the player depresses the push button switch 310*m* again, the controlling circuit 310*k* supplies the driving current to the electric motor unit 310*d*, and the rotatable shaft member 310*a* is driven for rotation in the opposite direction. When the other of the photo-interrupters 310*h* and 310*i* detects the shutter plate 310*g*, the controlling circuit 310*k* makes the decision that the cushion members 310*c* enters the other of the free position FP and the blocking position BP, and the controlling circuit 310*k* stops the driving current.

The decisions made by the controlling circuit 310*k* may be realized through a software executed by a processor unit incorporated in the electronic tone generating unit 220.

The photo-detector 310*h* has a generally U-shaped block member 311*a*, optical fibers 311*b* and 311*c* open to a space formed in the generally U-shaped block member 311*a* and one of photo-couplers 312. The generally U-shaped block member 311*a* is mounted on the rigid board member 310*j*, and the position of the generally U-shaped block member 311*a* is changeable on the rigid board member 310*j*. The end of the optical fiber 311*b* is aligned with the end of the optical fiber 311*c*, and a light beam is radiated therebetween.

Similarly, the photo-detector 310*i* has a generally U-shaped block member 312*a* is optical fibers 312*b* and 312*c* open to a space formed in the generally U-shaped block member 312*a* and another photo-coupler 312. The generally U-shaped block member 312*a* is mounted on the rigid board member 310*j*, and the position of the generally U-shaped block member 312*a* is changeable on the rigid board member 310*j*. The end of the optical fiber 311*b* is aligned with the end of the optical fiber 311*c*, and a light beam is radiated between the optical fibers 312*b* and 312*c*.

Figure 3A:
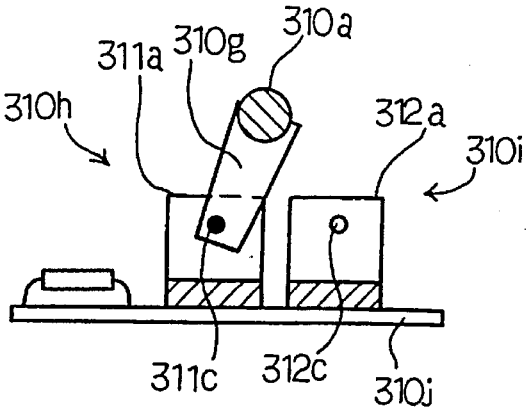
FIGS. 3A and 3B are views showing detections by photo-interrupters incorporated in the silent system.
Figure 3B:
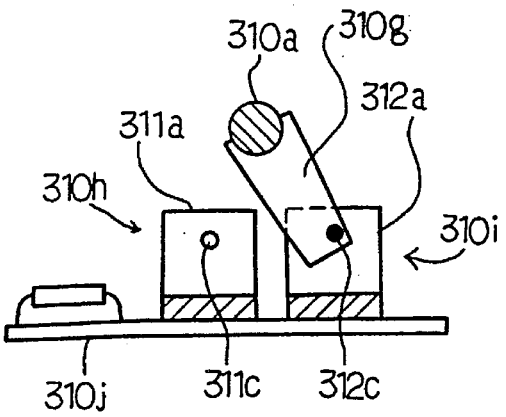

The generally U-shaped block member 311*a* is adjusted on the rigid board member 310*j* in such a manner that the shutter plate 310*g* interrupts the light beam between the optical fibers 311*b* and 311*c* upon an entry of the cushion members 310*c* into the blocking position BP (see FIG. 3A). On the other hand, the generally U-shaped block member 312*a* is adjusted on the rigid board member 310*j* in such a manner that the shutter plate interrupts the light beam between the optical fibers 312*b* and 312*c* upon an entry of the cushion members 310*c* into the free position FP (see FIG. 3B).

In this instance, the rotatable shaft member 310*a*, the bracket members 310*b* and the cushion members 310*c* as a whole constitute an interrupter, and the electric motor unit 310*d* serves as an actuator means. The photo-interrupters 310*h* and 310*i* serve as a first non-contact sensor and a second non-contact sensor, respectively.

The regulating button controller 320 comprises a change-over mechanism 321 (see FIG. 1), an electric motor unit 322 and a position controller 323. The regulating button controller 320 changes the regulating button mechanisms 110*h* between a spaced position SP and a closed position CP. Namely, while the keyboard musical instrument is staying in the acoustic sound mode, the regulating button controller 320 maintains the regulating button mechanisms 110*h* in the spaced position SP, and the regulating buttons 110*i* are spaced from the toes 110*g* by standard distances of the upright piano 100.

On the other hand, if the player selects the electronic sound mode, the regulating button controller 320 changes the regulating button mechanisms 110*h* to the closed position CP, and the regulating buttons 110*i* advance toward the toes 110*g*. As a result, the toes 110*g* are brought into contact with the regulating buttons 110*i* earlier than the acoustic sound mode.

As shown in FIG. 1, the change-over mechanism 321 includes a rotatable shaft member 321*a*, bearing units 321*b*, a bracket member 321*c*, a liner 321*d*, a stopper member 321*e* and a cushion member 321*f*. The rotatable shaft member 321*a* laterally extends between the front surface of the center rail 111 and the jacks 110*e*, and is connected at one end thereof to the electric motor unit 322 (see FIG. 2). The bearing units 321*b* are attached to the front surface of the center rail 111 at intervals, and rotatably support the shaft member 321*a*. The bracket member 321*c* is fixed to the rotatable shaft member 321*a*, and the regulating mechanisms 110*h* are supported by the bracket member 321*c*. The spring member 321*d* is connected between the front surface of the center rail 111 and the lower portion of the bracket member 321*c*, and urges the bracket member 321*c* in the clockwise direction. The spring member 321*d* forces the regulating button mechanisms 110*h* to be in the spaced position SP.

While the regulating button mechanisms 110*h* is in the spaced position SP, the upper portion of the bracket member 321*c* is held in contact with the liner 321*f* attached to the front surface of the center rail 111. The liner 321*f* defines the spaced position SP.

If the regulating button mechanisms 110*h* is changed to the closed position CP, the lower portion of the bracket member 321*c* is brought into contact with the stopper 321*e* also fixed to the front surface of the center rail 111. The stopper 321*e* defines the closed position CP.

The position controller 323 includes two photo-interrupters 323*a* and 323*b*, a shutter plate 323*c*, the controlling circuit 310*k* and the push button switch 310*m*.

The photo-interrupter 323*a* has a generally U-shaped block member 323*d*, optical fibers 323*e* and 323*f* open to a space formed in the generally U-shaped block member 323*d* and yet another photo-coupler 312. The generally U-shaped block member 323*d* is mounted on a rigid board member 324, and the position of the generally U-shaped block member 323*d* is changeable on the rigid board member 324. The end of the optical fiber 323*e* is aligned with the end of the optical fiber 323*f*, and a light beam is radiated therebetween.

Similarly, the photo-detector 323*b* has a generally U-shaped block member 323*g*, optical fibers 323*h* and 323*i* open to a space formed in the generally U-shaped block member 323*g* and still another photo-coupler 312. The generally U-shaped shaped block member 323*g* is mounted on the rigid board member 324, and the position of the generally U-shaped block member 323*g* is changeable on the rigid board member 324. The end of the optical fiber 323*h* is aligned with the end of the optical fiber 323*i*, and a light beam is radiated between the optical fibers 323*h* and 323*i*.

The generally U-shaped block member 323*d* is adjusted on the rigid board member 324 in such a manner that the shutter plate 323*c* interrupts the light beam between the optical fibers 311*b* and 311*c* upon an entry of the regulating button mechanisms 110*h* into the spaced position SP. On the other hand, the generally U-shaped block member 323*g* is adjusted on the rigid board member 324 in such a manner that the shutter plate 323*c* interrupts the light beam between the optical fibers 323*h* and 323*i* upon an entry of the regulating button mechanisms 110*h* into the closed position CP.

The photo-couplers 312 are connected to the controlling circuit 310*k*, and the controlling circuit 310*k* supplies and terminates the driving current as follows. When the player depresses the push button switch 310*m* for the electronic sound mode, the controlling circuit 310*k* supplies the driving current to the electric motor unit 322, and the shaft member 321*a* is driven for rotation in the counter clockwise direction. The bracket member 321*c* is also rotated in the counter clockwise direction, and the rotation is terminated at the stopper 321*e*. Then, the regulating button mechanisms 110*h* enter into the closed position CP, and the photo-interrupter 323*g* informs the controlling circuit 310*k* of the arrival at the closed position CP. The electric motor unit 322 continuously exerts the torque to the bracket member 321*c* and, accordingly, the regulating button mechanisms 110*h* during the electronic sound mode. As a result, even if the toe 110*g* pushes the regulating button 110*i*, the regulating button mechanisms 110*h* are maintained at the closed position CP. The controlling circuit may regulate the driving current at the closed position CP.

The player is assumed to depress the push button switch 310*m* again. The controlling circuit 310*k* changes the driving current, and the electric motor unit 322 rotates the shaft member 321*a* in the clockwise direction. The bracket member 321*c* and the regulating button mechanisms 110*h* are driven for rotation in the clockwise direction, and the upper portion of the bracket member 321*c* is brought into contact with the liner 321*f*. The shutter plate 323*c* concurrently interrupts the light beam between the optical fibers 323*e* and 323*f*, and the photo-interrupter 323*a* informs the controlling circuit 310*k* of the arrival at the spaced position SP. Then, the controlling circuit 310*k* terminates the driving current.

Description is hereinbelow made on a performance through the acoustic sounds. The player depresses the push button switch 310*m*, if necessary. The motor units 310*d* and 322 change or maintain the hammer stopper 310 and the regulating button controller 320 to or at the free position FP and the spaced position SP.

The player fingers on the keyboard 101 for performing a music. While the player is performing the music, the white key 101*b* is assumed to be depressed. The white key 101*b* is rotated in the counter clockwise direction, and the capstan screw 103 upwardly pushes the whippen heel 110*c*. The whippen 110*b* is rotated in the clockwise direction around the whippen flange 110*a*, and the jack 110*e* is also rotated around the whippen flange 110*a*. The jack 110*e* pushes the hammer butt 120*c*, and rotates the hammer butt 120*c* in the clockwise direction around the butt flange 120*a*.

While the whippen 110*b* is being rotated, the damper spoon 140*e* pushes the damper lever 140*b*, and rotates the damper lever 140*b* and the damper head 140*d* in the counter clockwise direction around the damper flange 140*a*. The damper head 140*d* leaves from the string 130, and allows the string 130 to vibrate.

When the toe 110*g* is brought into contact with the regulating button 110*i*, the regulating button 110*i* restricts the rotation of the jack 110*e* around the whippen flange 110*a*, and the jack 110*e* quickly turns around the jack flange 110*d* against the elastic force of the jack spring 110*f*. Then, the jack escapes from the hammer butt 120*b*, and the hammer head 120*d* rushes toward the string 130. The hammer head 120*d* strikes the string 130 without an interruption of the hammer stopper 310, and rebounds on the string 130. The string 130 vibrates, and generates the acoustic sound having the note assigned to the depressed white key 101*b*.

The hammer assembly 120 turns in the counter clockwise direction around the butt flange 120, and the back check 110*m* restricts the rotation of the hammer assembly 120. When the player releases the depressed white key 101*b*, the capstan screw 103 is spaced from the whippen heel 110*c*, and the whippen 110*b* is rotated in the counter clockwise direction around the whippen flange 110*a*. The hammer assembly 120 returns to the home position, and the jack spring 110*f* urges the jack 110*e* to return the position beneath the hammer butt 120*c*.

The rotation of the whippen 110*b* removes the force exerted by the damper spoon 140*e* from the damper lever 140*b*, and the damper spring 140*f* presses the damper head 140*d* against the string 130.

Thus, the black and white keys 101*a* and 101*b* sequentially actuate the key action mechanisms 110, the damper mechanisms 140 and the hammer assemblies, and the strings 130 selectively generates the acoustic sounds.

While the keyboard musical instrument is in the acoustic sound mode, the player is assumed to depress the push button switch 310*m*. The controlling circuit 310*k* checks the photo-interrupters 323*a* and 323*b* to see whether or not the shutter plates 310*g* and 323*c* interrupt the light beam of the photo-interrupter 310*i* and the light beam of the photo-interrupter 323*a*, respectively. If the answer is given affirmative, the hammer stopper 310 and the regulating button controller 320 are correctly positioned at the spaced position SP and the spaced position SP, and the controlling circuit 310*k* supplies the driving current to the electric motor units 310*d* and 322 so as to change the hammer stopper 310 and the regulating button controller 110*h* to the blocking position BP and the closed position CP.

Figure 4A:
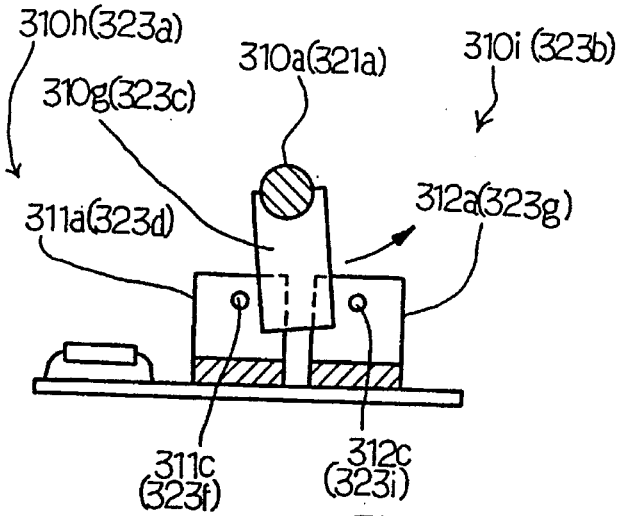
FIGS. 4A and 4B are views showing irregular positions of a shutter plate.
Figure 4B:
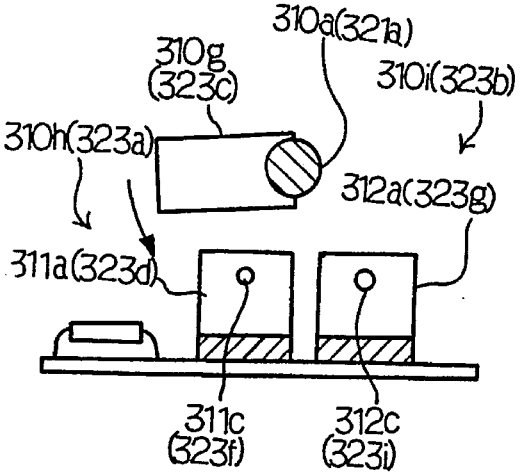

However, if both photo-interrupters 310*h*/ 310*i* or 323*a*/ 323*b* bridge the light beams, the shutter plate 310*g* or 323*c* is irregularly positioned as shown in FIG. 4A or 4B. If a main power switch (not shown) cuts off the electric power during the rotation of the shaft member 310*a* or 321*a*, the shutter plate 310*g* or 323*a* is position at the intermediate position shown in FIG. 4A. On the other hand, if a person forcibly rotates the shaft member 310*a* or 321*a*, the shutter plate 310*g* or 323*c* is moved out of the regular trajectory as shown in FIG. 4B.

In this situation, the controlling circuit 310*k* causes the electric motor units 310*d* and 322 to rotate the shaft members 310*a* and 323*c* in the counter clockwise direction. If the shutter plate 310*g* or 321*a* is in the intermediate position, the shutter plate 310*g* or 321*a* interrupts the light beam of the photo-interrupter 310*i* or 323*b*. When the controlling circuit 310*k* acknowledges the free position FP, the controlling circuit 310*k* changes the driving current, and the electric motor unit 310*d* rotates the shaft member 310*a* so as to change the hammer stopper 310 to the blocking position BP. On the other hand, when the controlling circuit 310*k* acknowledges the closed position CP, the controlling circuit 310*k* regulates the driving current, and continuously supplies it to the electric motor unit 322.

On the other hand, if the shutter plate 310*g* or 323*c* is out of the trajectory as shown in FIG. 4B, the rotation in the counter clockwise direction brings the shutter plate 310*g* or 323*c* to the interruption of the light beam of the photo-interrupter 310*h* or 323*a*. The controlling circuit 310*k* further rotates the shaft member 310*a* or 321*a* over the distance equal to the width of the shutter plate 310*g* or 323*c*, and stops the hammer stopper 310 or the regulating button controller 320 at the blocking position or the spaced position SP.

When the controlling circuit 310*k* acknowledges the blocking position BP, the controlling circuit 310*k* does not supply the driving current to the electric motor unit 310*d*.

However, if the photo-interrupter 323*d* reports the interruption to the controlling circuit 310*k*, the controlling circuit 310*k* further supplies the driving current to the electric motor unit 322, and causes the regulating button controller 320 to enter into the closed position CP.

If the electric motor units 310*d* and 322 are of a stepping motor, the shutter plates 310*g* and 323*c* exactly turn over the distance equal to the width of the shutter plates 310*g* and 323*c*.

In this instance, the controlling circuit 310*k* concurrently drives the electric motor units 310*d* and 322. The driving current may be supplied to one of the electric motor units 310*d* and 322, and the other electric motor unit 322 or 310*d* may be driven after the rotation of the shaft member 310*a* or 321*a*.

Thus, the photo-interrupters 310*h*/310*i* and 323*a*/323*b* exactly detect the free position SP/blocking position BP and the spaced position SP/closed position CP, and the controlling circuit 310*k* precisely positions the hammer stopper 310 and the regulating button controller 320. Moreover, an external force does not exert on the photo-interrupters 310*h*/310*i* and 323*a*/323*b*, and the photo-interrupters 310*h*/310*i* and 323*a*/323*b* are free from the aged deterioration.

After the entry into the blocking position BP and the closed position CP, the player starts a performance through a fingering on the keyboard 101. The white key 101*b* is assumed to be depressed. The capstan screw 103 pushes up the whippen heel 110*c*, and the whippen 110*b* and the jack 110*e* turn in the clockwise direction around the whippen flange 110*a*. The regulating button controller. 320 has already decreased the distance between the tow 110*g* and the regulating button 110*i*, and the toe 110*g* is brought into contact with the regulating button 110*i* earlier than that in the acoustic sound mode. This results in an earlier escape of the jack 110*e*, and the hammer assembly 120 certainly starts the free rotation before the rebound on the cushion member 310*c*. When the jack escapes from the hammer butt 120*b*, the player feels the key touch usual, and the regulating button controller 320 causes the key action mechanisms 110 and the hammer assemblies 120 to give the unique key touch of the acoustic piano to the player.

Even if the player repeats the white key 101*b*, the cushion member 310*c* is sufficiently spaced from the starting point of the free rotation, and the hammer assembly 120 is never caught between the jack 110*e* and the cushion member 310*c*.

The hammer shank 120*c* rebounds on the cushion member 310*c* before a strike at the string 130, and the string 130 does not vibrate. However, the key sensor 210 monitors the motion of the depressed white key 101*b*, and the electronic tone generating unit 220 tailors an audio signal corresponding to the acoustic sound generated by the strings 130. The audio signal is supplied to the headphone 230, and an electronic sound is generated through the headphone 230.

The intensity of the strike is proportionally varied with the angular velocity of the hammer assembly 120 in the free rotation. The electronic tone generating unit 220 may calculate the key velocity on the basis of the lapse of time between the photo-interrupters incorporated in the key sensor 210, and estimates the hammer velocity from the key velocity.

Thus, the player can practice a fingering on the keyboard 101 without an acoustic sound, and the electronic sound generating system 200 allows the player to confirm the fingering through the electronic sounds.

If the push button switch 310*m* is depressed again, the controlling unit 310*k* changes the hammer stopper 310 and the regulating button controller 320 to the free position FP and the spaced position, and the player can perform a music through the acoustic sounds again.

The manipulating switch panel 310*n* may be placed in the vicinity of the keyboard 101. If so, a child easily manipulates the switches, and enjoys the performance.

As will be appreciated from the foregoing description, the non-contact sensors, i.e., the photo-detectors 310*h*/310*i* and 323*a*/323*b* do not change the detecting points on the trajectories of the shutter plates 310*g*/321*a* by virtue of the non-contact detection, and the keyboard musical instrument can run without a maintenance of the position controllers.

Moreover, the push button switch 310*m* and the controlling circuit 310*k* are shared between the hammer stopper 310 and the regulating button controller 320, and both of the hammer stopper 310 and the regulating button controller 320 are concurrently changed by manipulating the push button switch 310*m*. The component parts of the silent system 300 are decreased, and both of the hammer stopper 310 and the regulating button controller 320 are surely changed depending upon the mode of operation.

Second Embodiment

Figure 5:
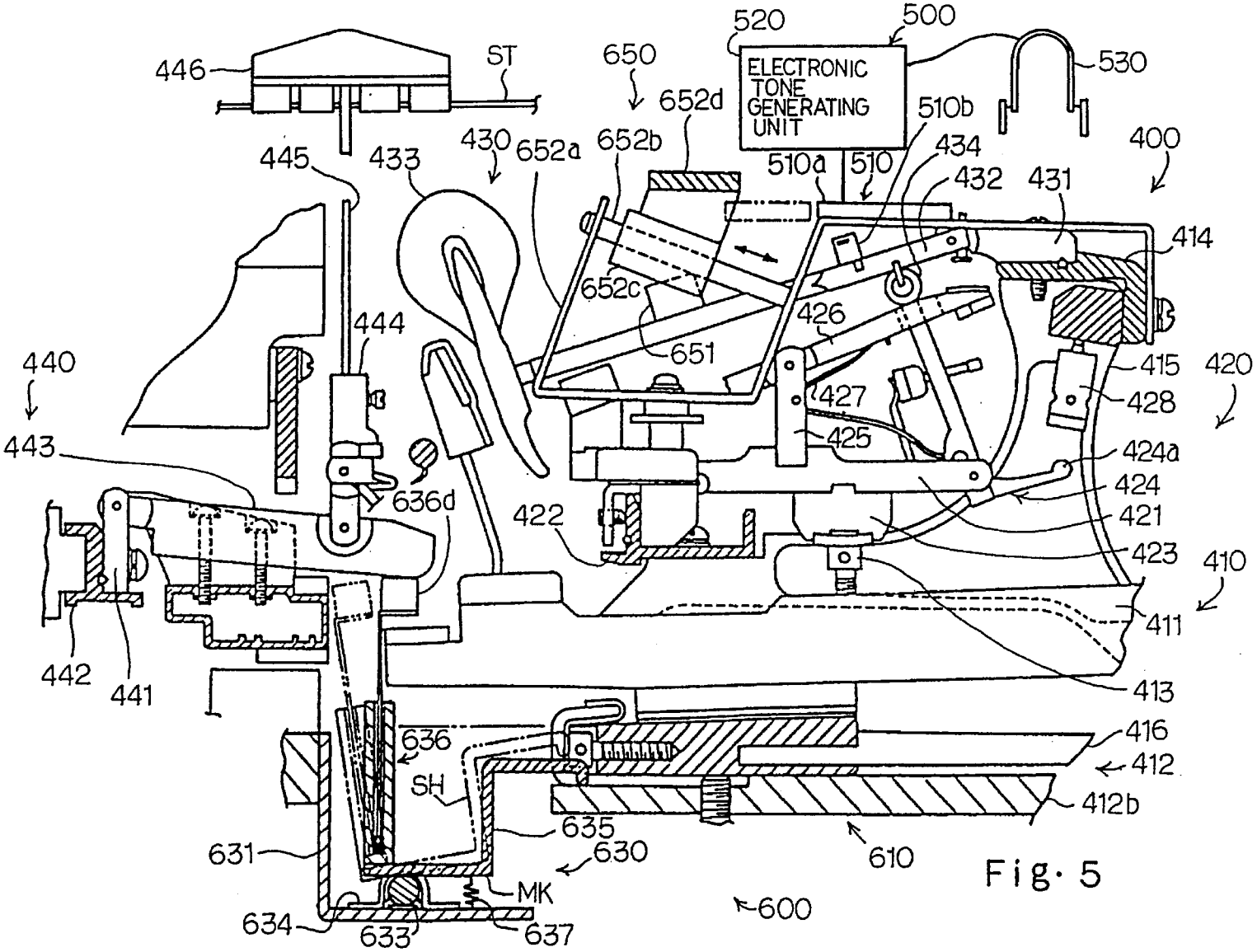
FIG. 5 is a partially cut-away side view showing an essential structure of a keyboard musical instrument according to the present invention.

Turning to FIG. 5 of the drawings, a grand piano 400, an electronic sound generating system 500 and a silent system 600 form parts of another keyboard musical instrument embodying the present invention.

The grand piano 400 comprises a keyboard 410, a plurality of key action mechanisms 420, a plurality of hammer assemblies 430, a plurality of strings ST and a plurality of damper assemblies 440.

The keyboard 410 is implemented by turnable black/white keys 411, and is mounted on a key bed structure 12. Capstan screws 413 project from the black/white keys 411, respectively.

The key bed structure 412 has a stationary key bed 412*a* and a movable key bed 412*b*, and the movable key bed 412*b* moves the stationary key bed 412*a* closer to and spaced from the stationary key bed 412*a*. The stationary key bed 412*a* is similar to a key bed of a standard grand piano. Namely, the stationary key bed 412*a* is connected to legs (not shown), and supports pedal mechanisms (not shown). A lifter is provided for the key bed structure 412, and forms a part of the silent system 500. The lifter is described in detail hereinlater together with other sub-systems of the silent system 500.

Each of the key action mechanisms 420 includes a whippen 421 turnably supported by a whippen flange fixed to a whippen rail 422 and a whippen heel 423 attached to a lower surface of the whippen 421, and the capstan screw 413 is held in contact with the whippen heel 423.

The key action mechanism 420 further includes a jack 424 turnably supported by the whippen 421, and has a generally L-shape. A tow 424*a* is formed on the short arm of the jack 424.

The key action mechanism 420 further includes a repetition lever flange 425 upright from the whippen 421, a repetition lever 426 turnably supported by the repetition lever flange 425 and a repetition spring 427 provided through the repetition lever flange 425 between the jack 424 and the repetition lever 426. The repetition lever 426 has a through hole, and the long arm of the jack 424 is inserted into the through hole. The repetition spring 427 urges the repetition lever 426 and the jack 424 in the counter clockwise direction.

The key action mechanism 420 further includes a regulating button mechanism 428 supported by a shank flange rail 414, and the shank flange rail 414 in turn is supported by action brackets 415. The action brackets 415 are provided on bracket blocks (not shown), respectivley, and the bracket blocks are mounted through a key frame 416 on the movable key bed 412*b*. The gap between the toe 424*a* and the regulating button mechanism 428 is regulable.

When a player depreses the key 411, the key 411 turns in the clockwise direction, and the capstan screw 413 pushes up the whippen heel 423. The whippen 421 and the jack 424 turn in the counter clockwise direction around the whippen flange, and the jack 424 forces the hammer assembly 430 to turn in the clockwise direction.

When the jack 424 is brought into contact with the regulating button mechanism 428, the jack 424 turns around the whippen 421, and escapes from the hammer assembly 430. Then, the hammer assembly 430 starts the free rotation, and rushes toward the string ST.

The hammer assembly includes a hammer shank flange 431 fixed to the hammer shank flange rail 414, a hammer shank 432 turnably connected to the hammer shank flange 431, a hammer head 433 fixed to the leading end of the hammer shank 432 and a roller 434 rotatably supported by the hammer shank 432. While the key 411 is staying at the rest position, the roller 434 is held in contact with a top surface of the long arm of the jack 424.

While the jack 424 is pushing the roller 434, the hammer shank 432 and, accordingly, the hammer head 433 are forcibly rotated in the clockwise direction around the hammer shank flange 431. After the escape, the hammer shank 432 and the hammer head 433 continuously turn in the clockwise direction around the hammer shank flange 431.

The string ST is implemented by a plurality of wires, and is horizontally stretched over the hammer assemblies 430. When the hammer head 433 strikes the string ST, the string ST vibrates for generating an acoustic sound.

The damper mechanism 440 includes a damper lever flange 441 fixed to a damper lever rail 442, a damper lever 443 turnably suported by the damper lever flange 441, a damper head 444 turnably suported by the damper lever 443, a damper wire 445 projecting from the damper head 444 and a damper head 446 fixed to the leading end of the damper wire 445. The damper head 446 is pressed against the string ST due to the self-weight, and the leading end of the damper lever 443 is over the rear end of the key 411.

When the key 411 is depressed, the capstan screw 413 pushes up the whippen heel 423 as described hereinbefore, and the rear end of the key 411 pushes up the leading end of hte damper lever 443. The damper levelr 433 turns in the counter clockwise direction around the damper lever flange 441, and the damper head 446 leaves the string ST so as to allow the string ST to vibrate upon the strike with the hammer head 433.

The grand piano 400 thus arranged is similar to a standard grand piano, and other components such as pedal mechanisms are not described for the sake of simplicity.

The electronic sound generating system 500 comprises a plurality of hammer sensors 510 for monitoring the hammer actions, an electronic tone generating unit 520 similar to that of the first embodiemnt and a headphone 530 for generaitng electronic sounds.

Each of the hammer sensors 510 has a plurality of photo-interrupters 510*a* and a shutter plate 510*b* attached the hammer shank 432, and reports the interruptions of the light beams of the photo-interrupters 510*a*.

While the player is performing a music through the electronic sounds, the hammer sensors 510 inform the electronic tone generating unit 520 of the photo-interruptions, and the electronic tone generating unit 520 calculates the hammer velocity for each rotated hammer assembly 430. The electronic tone generating unit 520 tailors an audio signal, and supplies the audio signal to the headphone 530. The headphone generates the electronic sounds, and the player confirms the music through the electronic sounds.

The silent system 600 largely comprises the lifter 610, a gap regulator 630, a hammer stopper 650, a push button switch 670 provided on a manipulating switch board 671 and a controlling circuit 680, and allows the player to perform a music without the acoustic sounds.

Figure 6:
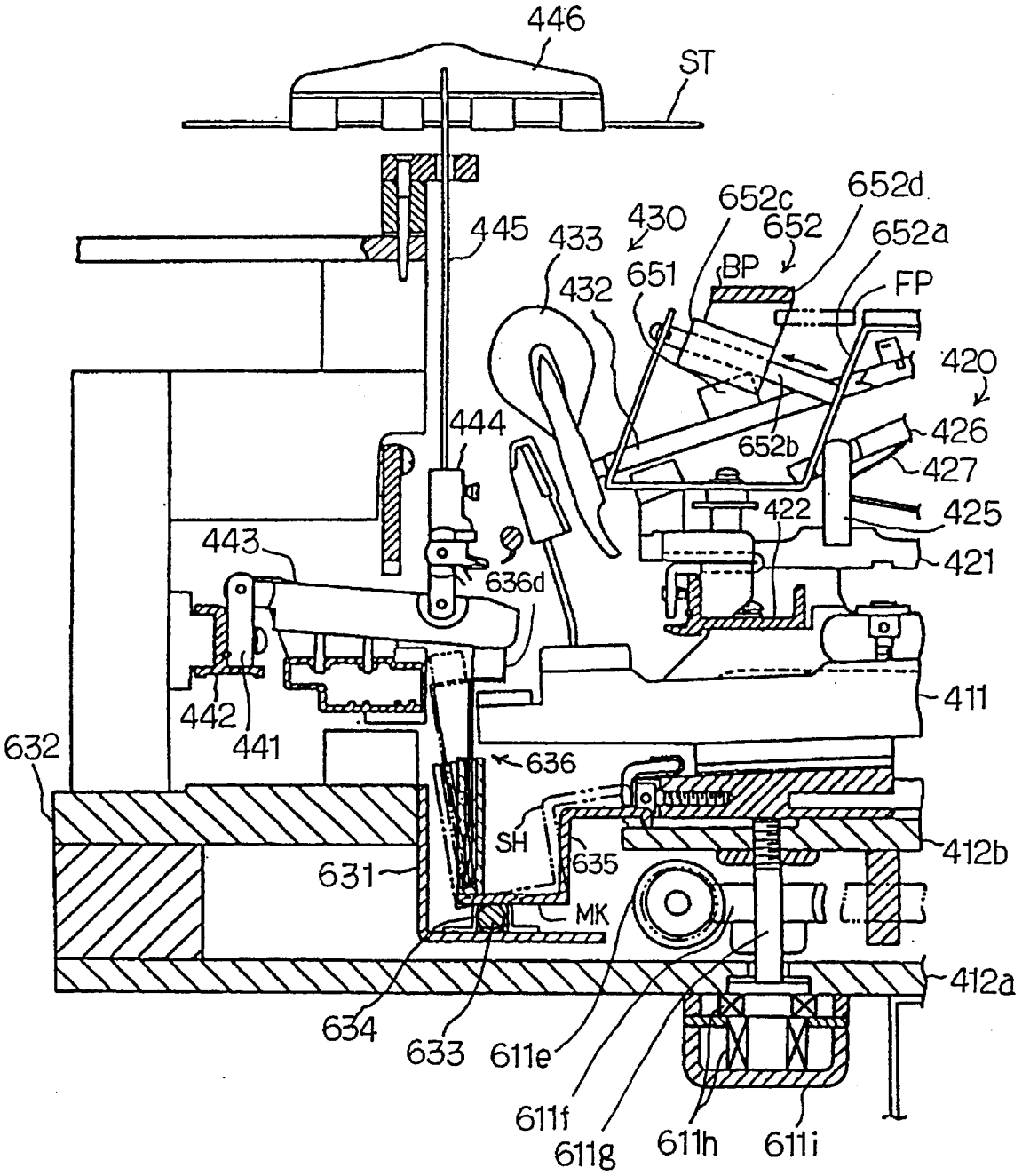
FIG. 6 is a partially cut-away side view showing a lifter incorporated in the keyboard musical instrument.
Figure 7:
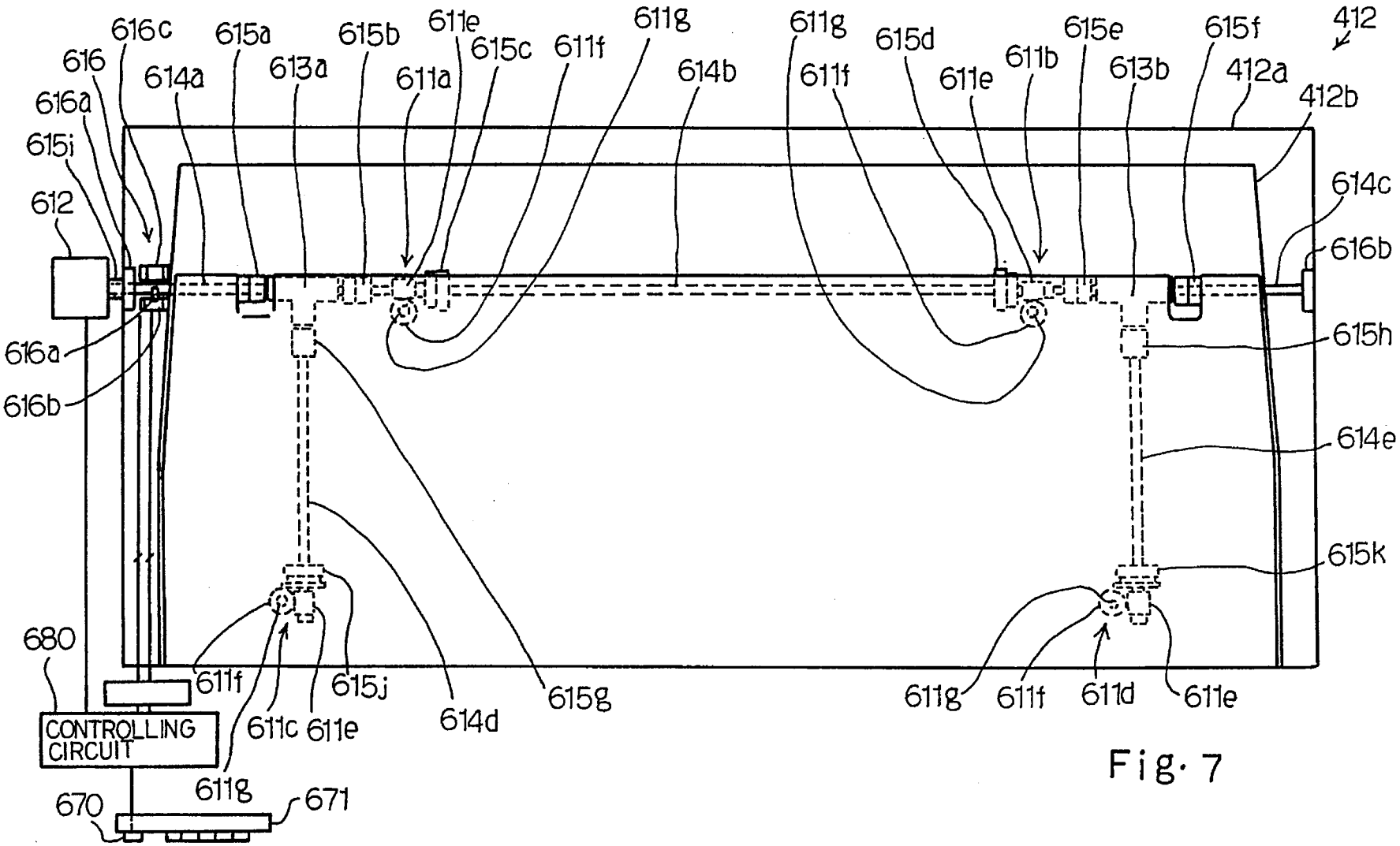
FIG. 7 is a plan view showing the lifter.
Figure 8:
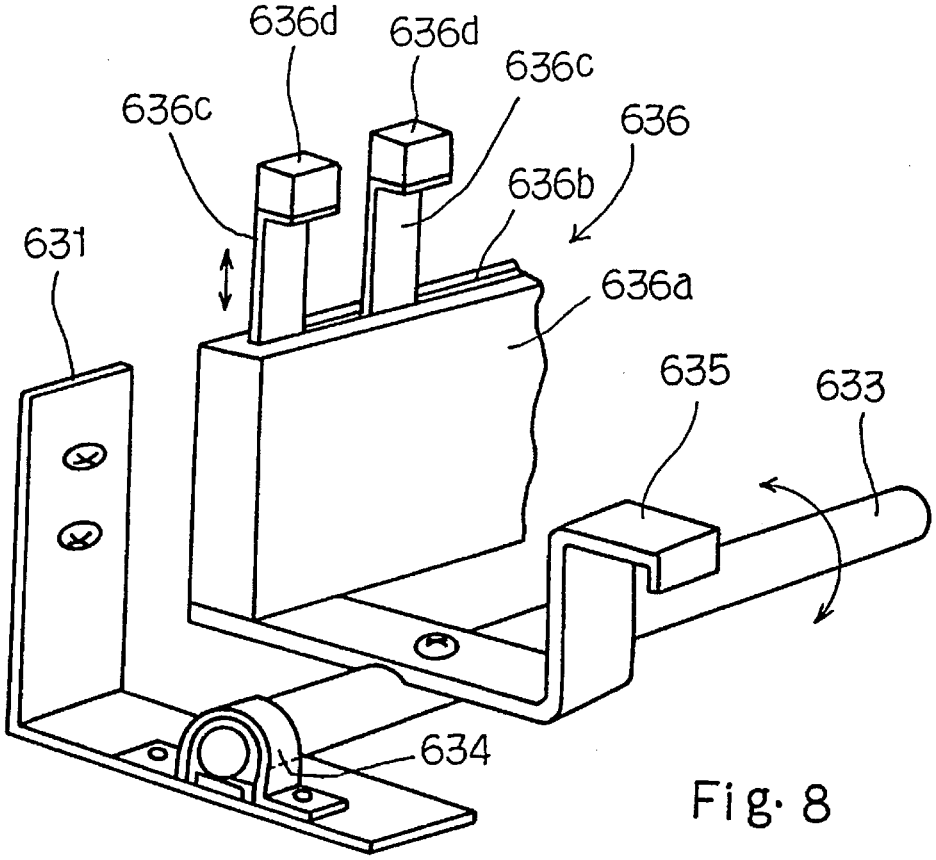
FIG. 8 is a perspective view showing the structure of a gap regulator incorporated in the keyboard musical instrument.

The lifter 610 is illustrated in FIGS. 6 and 7 in detail. The lifter 610 is provided between the stationary key bed 412*a* and the movable key bend 412*b*, and includes four jacks 611*a*, 611*b*, 611*c* and 611*d* provided at four corners of the key bed structure 412, an electric motor unit 612, bevel gear boxes 613*a* and 613*b*, rotatable shaft members 614*a*, 614*b*, 614*c*, 614*d* and 614*e*, coupling units 615*a*, 615*b*, 615*c*, 615*d*, 615*e*, 615*f*, 615*g*, 615*h*, 615*i*, 615*j* and 615*k* and a position controller 616.

The electric motor unit 612 is powered by the controlling circuit 680, and is bi-directionally rotated. The shaft of the electric motor unit 612 is connected through the coupling unit 615*i* to the shaft member 614*a*, and the shaft member 614*a* is rotatably supported by a bearing unit 616*a*.

The shaft member 614*a* is connected through the coupling unit 615*a* to the bevel gear box 613*a*, and the bevel gear box 613*a* transfers the rotation of the shaft member 614*a* through the coupling units 615*b* and 615*g* to the jack 611*a* and the shaft member 614*d*.

The shaft member 614*d* is connected through the coupling unit 615*j* to the jack 611*c*, and the jack 611*a* is coupled through the coupling unit 615*c* to the shaft member 614*b*. Thus, the rotation of the shaft member 614*a* is transferred to not only the jacks 611*a* and 611*c* but also the shaft member 614*b*.

The shaft member 614*b* is connected through the coupling unit 615*d* to the jack 611*b* which in turn is connected through the coupling unit 615*e* to the bevel gear unit 613*b*. The bevel gear unit 613*b* has two output shafts, and the two output shafts are coupled through the coupling units 615*f* and 615*h* to the shaft members 614*c* and 614*e*, respectively. The shaft member 614*c* is rotatably supported by a bearing unit 616*b*, and the other shaft member 614*e* is connected through the coupling unit 615*k* to the jack 611*d*.

Thus, the rotation of the shaft member 614*b* is transferred to the other jacks 611*b* and 611*d*.

The jacks 611*a* to 611*d* are similar to one another, and a worm 611*e*, a worm wheel 611*f* and a vertical shaft 611*g* form in combination each of the jacks 611*a* to 611*d*.

As will be better seen in FIG. 6, a lower portion of the vertical shaft 611*g* projects through the stationary key bed 412*a*, and a leading end portion is threaded. The lower end portion of the vertical shaft 611*g* is supported by bearing members 611*h*, and the bearing members 611*h* are housed in a bearing box 611*i*.

The threaded leading end portion is screwed into a female screw formed in the movable key bed 412*b*, and, accordingly, the movable key bed 412*b* is supported through the vertical shafts 611*h* of the four jacks 611*a* to 611*d* by the stationary key bed 412*a*. The worm wheel 611*f* is fixed to an intermediate portion of the vertical shaft 611*g*, and is meshed with the worm 611*e*.

When the worms 611*e* are rotated in one direction, the worm wheels 611*f* rotate the vertical shafts 611*g*, and the vertical shafts 611*g* lifts the movable key bed 412 with respect to the stationary key bed 412*a*.

On the other hand, when the worms 611*e* are rotated in the opposite direction, the vertical shafts 611*g* pull down the movable key bed 412*b*.

Turning back to FIG. 7, a shutter plate 616*a* and photo-interrupters 616*b* and 616*c* as a whole consititute the position controller 616. The shutter plate 616*a* is fixed to the shaft member 614*a*, and the photo-interrupters 616*b* and 616*c* are similar to the photo-interrupters 310*h*/310*i*/323*a*/323*b*.

When a player pushes the push button switch 670, the electric motor unit 612 is rotated in either direction, and the movable key bed 412*b* is changed from an upper position to a lower position or vice versa. The movable key bed 412*b* stays at the upper position during the acoustic sound mode, and is changed to the lower position in the electronic sound mode. As described hereinbefore, the black and white keys 411, the key action mechanisms 420 and the hammer assemblies 430 are supported by the movable key bed 412*b*, and the gap between the hammer heads 433 and the strings ST is increased upon the change from the acosutic sound mode to the electronic sound mode.

The gap regulator 630 includes a bracket member 631 fixed to a block member 632 stationary with respect to the stationary key bed 412*a*, a shaft member 633 rotatably supported by a bearing unit 634 mounted on the bracket member 631, a lever 635 bolted to the shaft member 633 and a spacer 636 fixed to the lever 635. As will be better understood, the spacer 636 has a case 636*a* fixed to the lever 635, and a guide slot 636*b* is formed in the case 636*a*. The gap regulator 639 further includes a plurality of sliding plates 636*c* slidably inserted into the guide slot 636*b*, and spacer blocks 636*d* are attached to the sliding palres 636*c*, respectively. The spacer blocks 636*d* are respectively associated with the plurality of black and white keys 411, and the lever 635 is held in contact with the movable key bed 412*b* (see FIG. 6) by means of a spring 637. The spacer blocks 636*d* may be formed of a resilient material, and serve as cushions.

While the movable key bed 412*b* is staying at the upper position, the lever 635 and the spacer 636 decline, and the spacer blocks 636*d* are moved out of the trajectories of the rear end of the black and white keys 411. The position of the spacer blocks 636*d* out of the trajectories are called as a shunt position SH.

On teh other hand, if the movable key bed 412*b* is lowered, the lever 635 and the spacer 636 turn in the clockwise direction around the bearing unit 634, and the spacer blocks 636*d* are moved into the trajectories of the end portions of the black and white keys 411. The spacer blocks 636*d* are placed beneath the leading ends of the damper levers 443, and the position in the trajectories is called as a make-up position MK.

Figure 9:
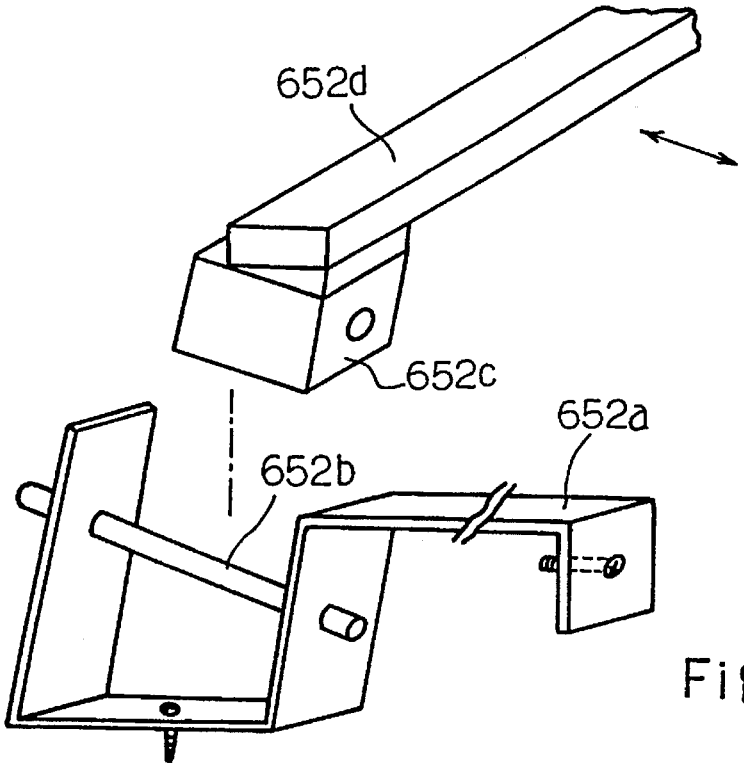
FIG. 9 is a disassembled perspective view showing the structure of a shank stopper incorporated in the keyboard musical instrument.

The hammer stopper 650 includes a plurality of cushion members 651 attached to the hammer shanks 651, a shank stopper 652, a driving mechanism 653 for the shank stopper 652 and a position controller 654, and FIG. 9 illustrates the shank stopper 652.

The shank stopper 652 has frames 652*a*, guide rods 652*b* fixed to the frames 652*a*, sliders 652*c* slidably supported by the guide rods 652*b* and a stopper plate 652*d* fixed to the sliders 652*c* and moved by the driving mechanism 653. The key action mechanisms 420 are grouped into three sections, i.e., the key action mechanisms for low pitch tones, the key action mechanisms for middle pitch tones and the key action mechanisms for high-pitch tones. The frames 652*a* are provided on both sides of the key action mechanisms 420 and between the three sections, and are supported by the whippen rail 422 and the action brackets 415. The guide rods 432 are oblique, and the stopper plate 652*d* is changed in height from the movable key bed 412*b* depending upon the position of the sliders 652*c* on the guide rods 652*b*.

While the keyboard musical instrument is staying in the acoustic sound mode, the stopper plate 652*d* is out of the trajectories of the hammer shanks 432, and the hammer heads 433 strike the strings ST without an interruption of the stopper plate 652*d*. This position is called as a free position FP.

On the other hand, if the keyboard musical instrument is changed to the electronic sound mode, the stopper plate 652*d* is confronted with the cushion members 651, and the cushion members rebound on the stopper plate 652*d* before a shrike with the hammer head 433 against the string ST. This position is called as a blocking position BP.

Figure 10:
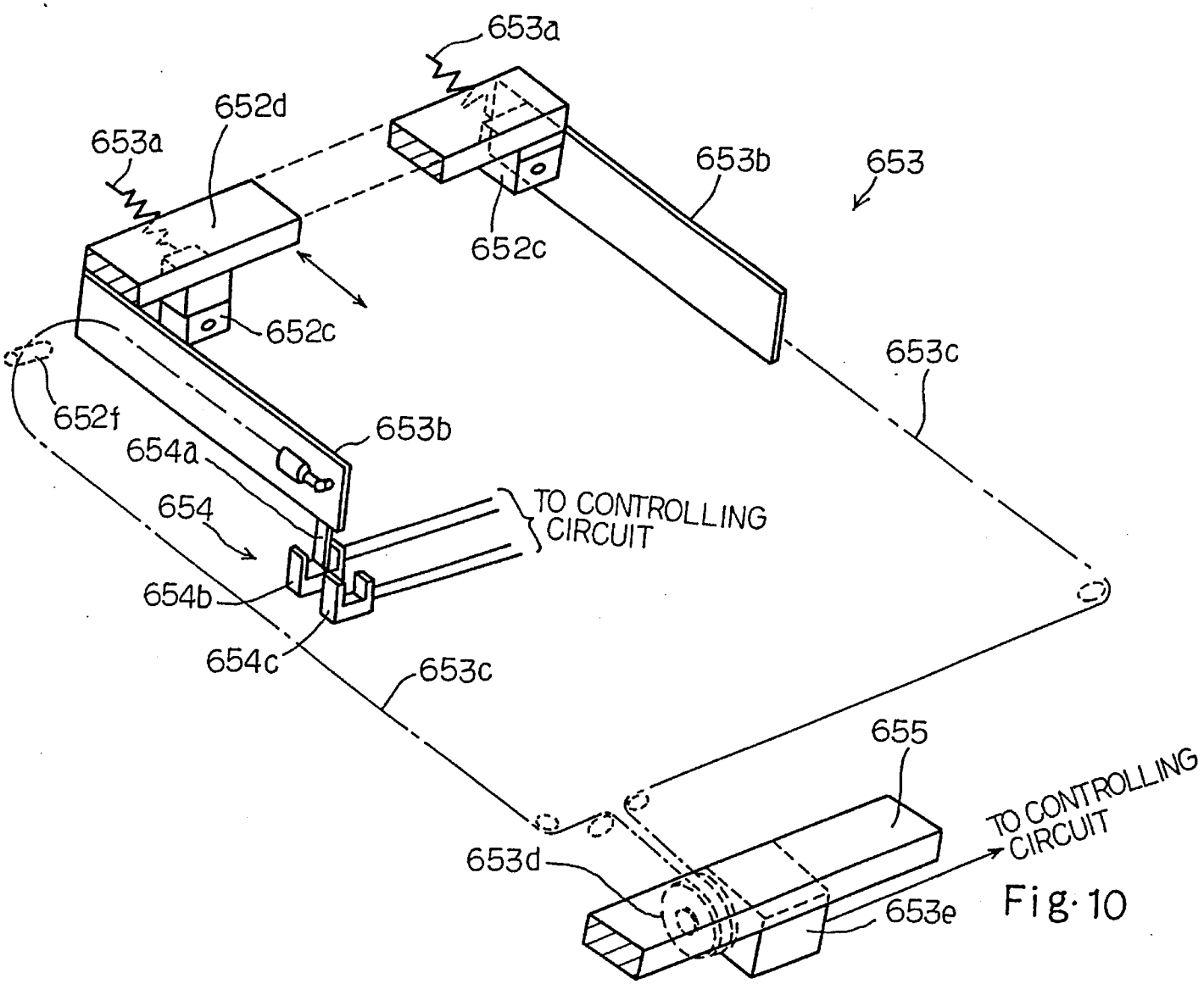
FIG. 10 is a perspective view showing a driving mechanism for the shank stopper.

The driving mechanism 653 is illustrated in FIG. 10, and includes coil spring 653*a* connected between the sliders 652*c* and the frame 652*a*, side plate members 653*b* connected to both sides of the stopper plate 652*d*, flexible wires 653*c* connected between the side plate members 653*b* and a pulley 653*d* and an electric motor unit 653*e* fixed to a stationary board member 655 forming a part of the piano case. Idle pulleys 652*f* turn back the flexible wires 653*c*, and change the motion of the flexible wires 653*c*.

The position controller 654 includes a shutter plate 654*a* and two photo-interupters 654*b* and 654*c*. The photo-interrupters 654*b* and 654*c* are similar to those of the first embodiment, and the shutter plate 654*a* interrupts the light beam of the photo-interrupter 654*b* at the blocking position BP and the light beam of the photo-interrupter 654*c* at the free position FP. The detection of the free position FP and the detection of the blocking position BP are reported to the controlling circuit 680.

The electric motor unit 653*e* is controlled by the controlling circuit 680. Namely, if the player depresses the push button switch 670 in the acoustic sound mode, the controlling circuit 680 supplies driving current to the electric motor unit 653*e*, and the flexible wires 653*c* are wound on the pulley 653*d*. The side plate members 653*b* and the sliders 652*c* are rearwardly moved. When the shutter plate 654*a* interrupts the light beam of the photo-interrupter 654*b*, the stopper plate 652*d* enters into the blocking position BP, and the controlling circuit 680 stops the driving current.

On the other hand, if the player depresses the push button switch 670 in the electronic sound mode, the controlling circuit 680 confirms the present position of the hammer stopper 650, and supplies the driving current the electric motor unit 653*e*. The flexible wires 653*c* are wound off, and the coil springs 653*a* urge the sliders 652*c* and the stopper plate 652*d*. When the shutter plate 654*a* interrupts the light beam of the photo-interrupter 654*c*, the controlling circuit 680 stops the driving current, and the hammer stopper 650 enters into the free position FP.

The keyboard musical instrument behaves in the acoustic sound mode as follows. Assuming now that the keyboard musical instrument has entered into the electronic sound mode, a player depresses the push button switch 670, and the controlling circuit 680 confirms the blocking position BP and the lower position. If the hammer stopper 650 and/or the lifter 610 are not in the blocking position BP and/or the lower position, the controlling circuit 680 regulates the hammer topper 650 and the lifter 610 as similar to the first embodiment described in conjunction with FIGS. 4A and 4B.

The controlling circuit 680 supplies the driving current to the electric motor units 653*e* and 612. The electric motor unit 653*e* winds off the flexible wires 653*c* until the shutter plate 654*a* interrupts the light beam of the photo-interrupter 654*c*, and the hammer stopper 650 enters into the free position FP.

Similarly, the electric motor unit 612 rotates the shaft member 614*a* untill the shutter plate 616*a* interrupts the light beam of the photo-interrupter 616*b*, and the jacks 611*a* to 611*d* pushes up the movable key bed 412*b* . The movable key bed 412*b* enters into the upper position.

When the movable key bed 412*b* is in the upper position, the gap between the strings ST and the hammer heads 433 are adjusted to appropriate values equal to the standard grand piano.

The movable key bed 412*b* rotates the lever 635 in the counter clockwise direction, and the spacer blocks 636*d* are changed to the shunt position SH.

The player starts the performance on the keyboard, and the key 411 is assumed to be depresses. The key turns in the clockwise direction, and the capstan screw 413 pushes up the whippen heel 423. The whippen 421 and the jack 424 turns in the counter clockwise direction around the whippen flange, and the jack 424 pushes up the hammer assembly 430. The hammer shank 432 and the hammer head 433 turn in the clockwise direction around the hammer shank flange 431.

The rear end portion of the key 411 pushes up the damper lever 443, and the damper head 446 leaves the string ST.

When the toe 424*a* is brought into contact with the regulating button mechanism 428, the jack 424 quickly turns around the whippen 421, and escapes from the hammer roller 434. The jack 424 imparts kinetic energy to the hammer assembly 430 upon the escape, and the hammer assembly 430 starts a free rotation in the clockwise direction around the hammer shank flange 431.

The hammer head 433 strikes the string ST, and rebounds thereon. The string ST vibrates for generating the acoustic sound. After the player releases the depressed key 411, the hammer assembly 430 returns to the home position, and the jack 424 returns to the initial position beneath the hammer roller 434.

Subsequently, the player wants to play the keyboard musical instrument in the electronic sound mode. The player depresses the push button switch 670, and the controlling circuit 680 supplies the driving current to the electric motor unit 653*e* and 612.

The electric motor unit 653*e* winds the flexible wires 653*c* on the pulley 653*d* until the shutter plate 654*a* interrupts the light beam of the photo-interrupter 654*b*, and the hammer stopper 650 enters into the blocking position BP.

The electric motor unit 612 rotates the shaft member 614*a* vice versa until the shutter plate 616*a* interrupts the light beam of the photo-interrupter 616*c*. The jacks 411*a* to 411*d* pull down the movable key bed 412*b*, and the movable key bed 412*b* enters into the lower position. In this situation, though the gap between the toes 424*a* and the regulating button mechanisms 428 is unchanged, the hammer assemblies 430 are spaced from the strings ST.

The downward motion of the movable key bed 412*b* allows the lever 635 to turn in the clockwise direction, and the gap spacer blocks 636*d* enter into the make-up position.

The player can start a fingering on the keyboard. While the player is performing the music, the key 411 is assumed to be depressed. The capstan screw 413 pushes up the whippen heel 423, and the whippen 421 and the jack 424 turn in the counter clockwise direction around the whippen flange. The jack 424 pushes up the hammer roller 434, and the hammer assembly 430 turns in the clockwise direction around the hammer shank flange 431.

The rear end portion of the key 411 is brought into contact with the spacer block 636*d*. The slider 636 upwardly slides, and the rear end portion of the key 411 rotates the damper lever 443. As a result, the damper head 446 leaves the string ST, and the damper head 446 provides a load to the key 411 as similar to the acoustic sound mode.

When the toe 424*a* is brought into contact with the regulating button mechanism 428, the jack 424 quickly turns around the whippen 421, and escapes from the hammer roller 434 before the interruption of the rotation of the hammer assembly 430. Thus, the jack 424 surely escapes from the hammer roller 434, and the player feels the key touch as usual.

The hammer assembly 430 starts the free rotation, and the cushion member 651 rebounds on the stopper plate 652*d*. The hammer action is monitored by the hammer sensor 510*a*, and the electronic tone generating unit 520 tailors an audio signal. The audio signal is supplied to the headphone 530, and generates the electronic sound having the note corresponding to the acoustic sound.

When the player releases the depressed key 411, the hammer assembly 430 returns to the home position, and the jack 424 returns to the initial position beneath the hammer roller 434.

As will be understood from the foregoing description, the photo-interrupters 616*b*/616*c* and 654*b*/654*c* detect the shutter plates 616*a*/654*a* without an physical contact, and the detecting points are not permanently changed. Moreover, the controlling circuit 680 is responsive to the push button switch 670 so as to concurrently change the hammer stopper 650, the lifter 610 and the gap regulator 630, and the player is released from a complicated manipulation.

Third Embodiment

Figure 11:
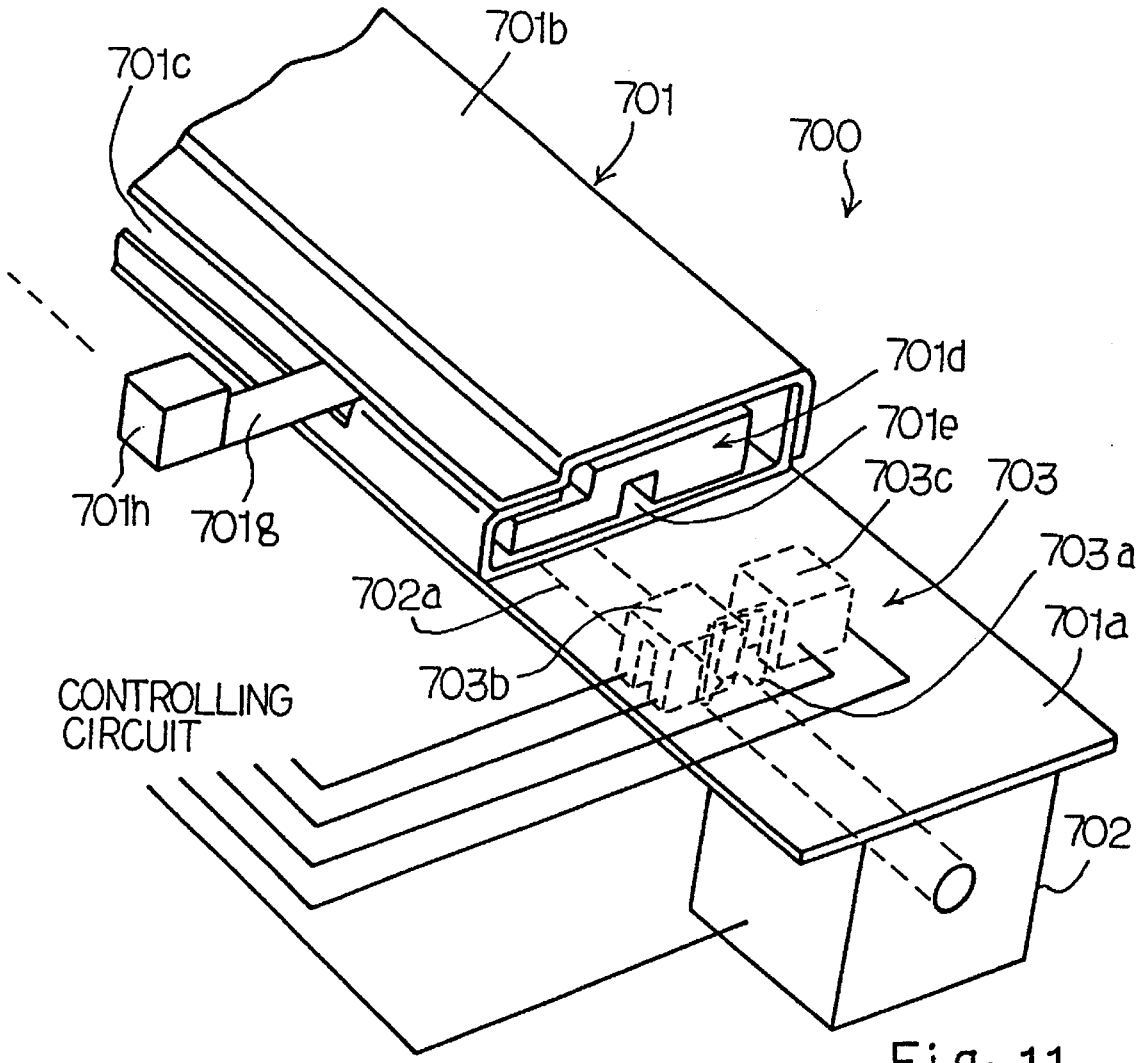
FIG. 11 is a perspective view showing a gap regulator incorporated in yet another keyboard musical instrument according to the present invention.
Figure 12:
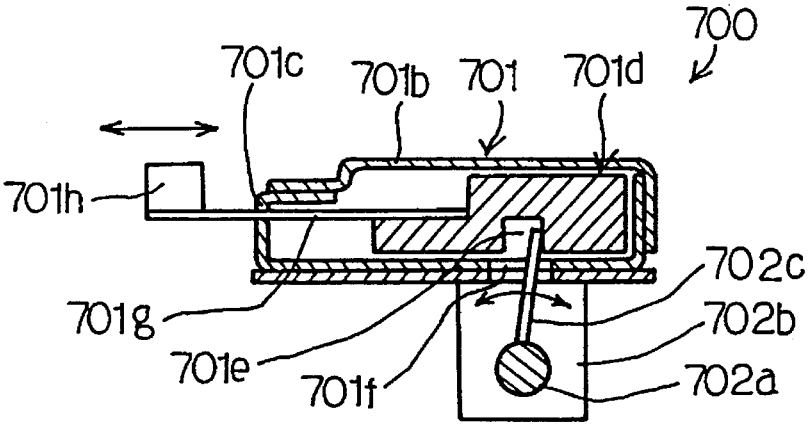
FIG. 12 is a cross sectional view showing a slider of the gap regulator.

FIGS. 11 and 12 illustrate yet another keyboard musical instrument embodying the present invention. The keyboard musical instrument implementing the third embodiment also comprises a grand piano, an electronic sound generating system and a silent system. The grand piano and the electronic sound system are similar to those of the second embodiment, and a gap regulator 700 of the silent system is only different from the gap regulator 630. For this reason, the gap regulator 700 is described hereinbelow in detail. The similar components are designated in the following description by using the same references as the second embodiment.

The gap regulator 700 is placed under the damper mechanisms 440, and largely comprises a spacer mechanism 701, an electric motor unit 702 and a position controller 703. Thought the gap regulator 630 is changed by the movable key bed 412*b*, the gap regulator 700 is directly controlled by the controlling circuit 680.

The spacer mechanism 701 includes a base plate member 701*a* extending in the lateral direction of the grand piano and an elongated case 701*b* having a slot 701*c* formed in the front surface thereof, and the slot 701*c* is directed to the rear end of the black and white keys 411.

The spacer mechanism 701 further includes a sliding block 701*d* accommodated in the elongated case 701*b*, and an elongated hollow space 701*e* is open at the bottom surface of the sliding block 701*d*. The elongated hollow space 701*e* is aligned with an elongated opening 701*f* formed in the base plate member 701*a* and the bottom plate of the elongated case 701*b*.

The spacer mechanism 701 further includes a plurality of leaf spring members 701*g* fixed to the sliding block 701*d* at intervals, and the leading end portions of the leaf spring members 701*g* project from the slot 701*c*.

The spacer mechanism 700 further includes a plurality of cushion blocks 701*h* formed of felt, and the plurality of cushion blocks 701*h* are attached to the leading end portions of the leaf spring members 701*g*. The leaf spring members 701*g* and, accordingly, the cushion members 701*h* are associated with the plurality of black and white keys 411 as well as the damper mechanisms 440.

The electric motor unit 702 is connected to a shaft member 702*a*, and the shaft member 702*a* is rotatably supported by bearing units 702*b* at intervals. A plurality of pushers 702*c* are fixed to the shaft member 702*a* at intervals, and pass the opening 701*f* so as to reach the elongated hollow space 701*e*. The controlling circuit 680 bi-directionally rotates the electric motor unit 702, and pushers 702*c* reciprocally slide the sliding block 701*d* in the elongated case 701*b*.

The position controller 703 includes a shutter plate 703*a* attached to the shaft member 702*a* and two photo-interrupters 703*b* and 703*c* provided on both sides of the shaft member 702*a*, and the shutter plate 703*a* selectively interrupts the light beams of the photo-interrupters 703*b* and 703*c*. The photo-interrupters 703*b* and 703*c* are similar to those of the first and second embodiments.

The gap regulator 700 thus arranged behaves as follows. If a player depresses the push button switch 670 so as to change the keyboard musical instrument to the electronic sound mode, the controlling circuit 680 concurrently supplies the driving current to the electric motor units 612 and 653*e*, and the hammer stopper 650 and the movable key bed 412*b* are changed to the blocking position BP and the lower position. The electric motor units 612 and 653*e* may start the rotation at different timings.

When the shutter plate 616*a* interrupts the photo-interrupter 616*c*, the controlling circuit 680 acknowledges the lower position, and stops the driving current to the electric motor unit 612. Thereafter, the controlling circuit 680 supplies the driving current to the electric motor unit 702, and the electric motor unit 702 rotates the shaft member 702*a* in the counter clockwise direction.

The pushers 702*c* slide the sliding block 701*d* to the left side, and the leaf spring members 701*g* projects from the slot 701*c*. The cushion blocks 701*h* are respectively placed beneath the leading ends of the damper levers 443.

When the cushion blocks 701*h* reach the positions beneath the damper levers 443, the shutter plate 703*a* interrupts the light beam of the photo-interrupter 703*b*, and the controlling circuit 680 acknowledges the make-up position MK. Then, the controlling circuit 680 stops the driving current.

On the other hand, if the player depresses the push button switch 670 so as to change the keyboard musical instrument to the acoustic sound mode, the controlling circuit 680 firsfly supplies the driving current to the electric motor unit 702, and the electric motor unit 702 rotates the shaft member 702*a* in the clockwise direction. The controlling circuit may concurrently supply the driving current to the electric motor unit 653*e* so as to change the hammer stopper 650 to the free position FP.

The pushers 702*c* backwardly slide the sliding block 701*d*, and the leaf spring members 701*g* are retracted into the elongated case 701*b*.

When the cushion blocks 701*h* are moved out of the trajectories of the rear end portions of the black and white keys 411, the shutter plate 703*a* interrupts the light beam of the photo-interrupter 703*c*, and the controlling circuit 680 acknowledges the shunt position SH. Then, the controlling circuit 680 stops the driving current supplied to the electric motor unit 702.

Thereafter, the controlling circuit 680 supplies the driving current to the electric motor unit 612, and changes the movable key bed 412*b* to the upper position.

Thus, the all of the position controllers 616, 654 and 703 are implemented by the non-contact sensors, and the detecting points are permanently unchanged. The controlling circuit 680 releases the player from complicated manipulation.

Moreover, the controlling circuit 680 supplies the driving current to the electric motor units 612 and 702 at different timings, and the movable key bed 412*b* is never brought into collision with the gap regulator 701.

Fourth Embodiment

Figure 13:
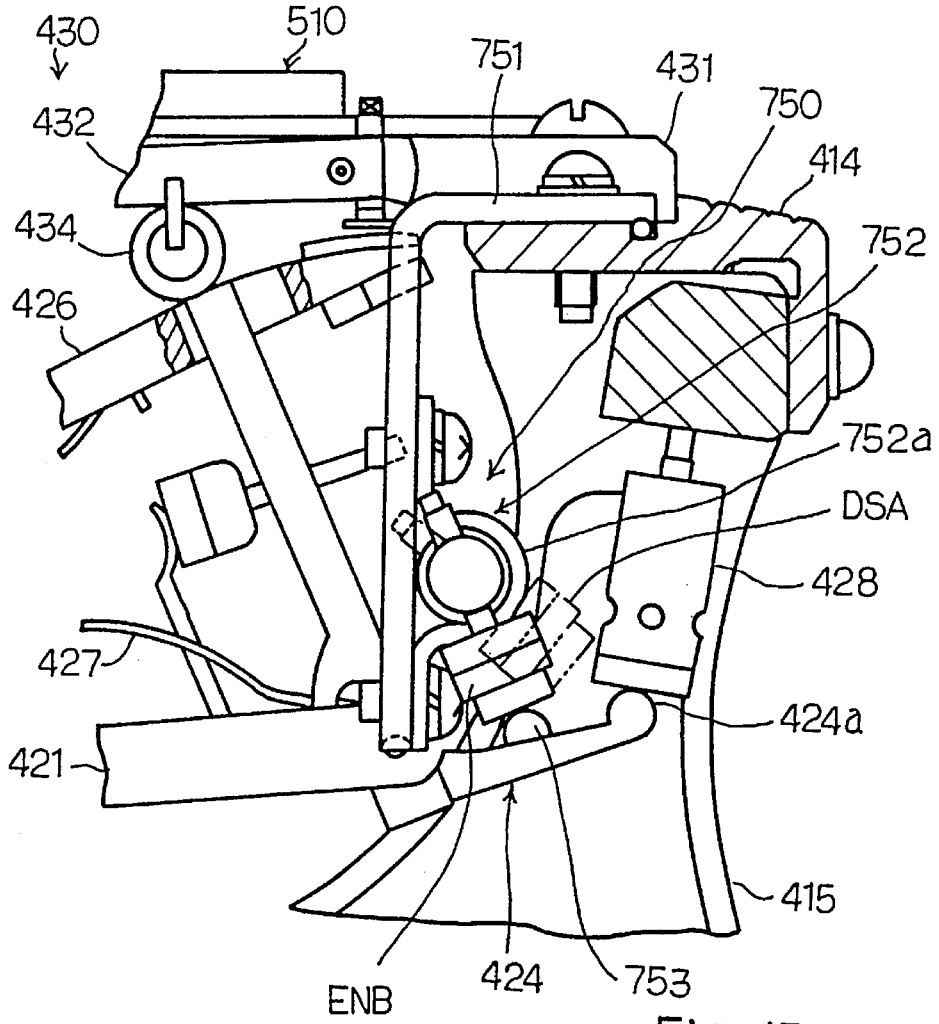
FIG. 13 is a side view showing a regulating button controller incorporated in still another keyboard musical instrument according to the present invention.
Figure 14:
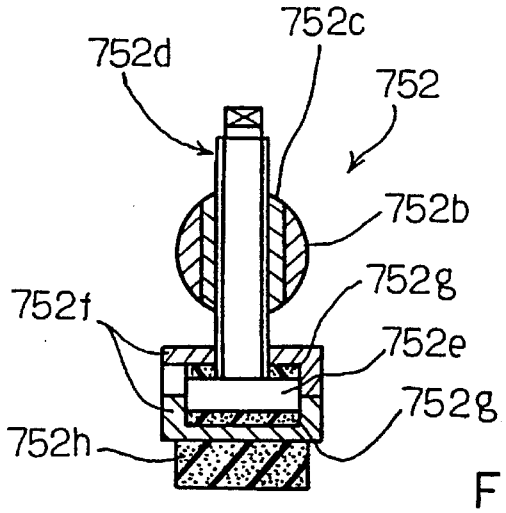
FIG. 14 is a cross sectional view showing an auxiliary regulating button incorporated in the regulating button controller.

FIGS. 13 and 14 illustrate a muting system 750 incorporated in still another keyboard musical instrument embodying the present invention. The keyboard musical instrument implementing the fourth embodiment comprises a grand piano, an electronic sound generating system, a silent system and the muting system 750, and the grand piano, the electronic sound system and the silent system are similar to those of the second embodiment. For this reason, components of these systems are labeled with the same references in the following description.

The muting system 750 includes a generally inverted L-shaped bracket member 751 bolted to the shank rail 414, an auxiliary regulating button mechanism 752 rotatably supported by bearing units 752*a* on the generally inverted L-shaped bracket member 751 and an auxiliary toe 753 formed on the short portion of the jack 424. The auxiliary regualting button mechanism 752 is changed between an enabled position ENB and disabled position DSA by an electric motor unit (not shown) associated with a position controller (not shown). The electric motor unit and the position controller are similar to those shwon in FIG. 2, and are connected to the controlling circuit 680.

While the auxiliary regulating button mechanism 750 is staying in the disabled position DSA, the keyboard musical instrument behaves in the acosutic sound mode.

On the other hand, when the auxiliary regulating button mechanism 750 enters into the enabled position ENB, the auxiliary toe 753 is brought into contact with the auxiliary regulating button mechanism 752, and the jack 424 turns in the clockwise direction at an angular speed greater than the turn upon the contact between the toe 424*a* and the regualting button mechanism 428. This results in a quick escape, and the jack 424 imparts a kinetic energy smaller than that in the acoustic sound mode to the hammer assembly 430. For this reason, the hammer heads 433 softly strike the stirings ST, and the strings ST weakly vibrate.

The auxiliary regulating button mechanism 752 includes a shaft member 752*b* connected to the electric motor unit (not shown), a plurality of bushes 752*c* inserted into the shaft member 752*b* at intervals and a plurality of auxiliary regulating screws 752*d* respectively associated with the jacks 424 and screwed into the bushes 752*c*. When the auxiliary regulating screw 752*d* is rotated, the auxiliary regulating screw 752*d* is retracted into and projects from the bush 752*c*.

The auxiliary regulating screws 752*d* have respective heads 752*e*, and the auxiliary regulating button mechanism 752 further includes a plurlity of cases 752*f*, pairs of clothes 752*g* inserted between the heads 752*e* and hte cases 752*f* and a plurality of cushion sheets 752*h* attached to the lower surfaces of the cases 752*f*, respectively.

Another push button switch (not shown) is assigned the muting system 750. When the push button switch is depressed by a player in the acosutic sound mode, the controling circuit 680 supplies the driving current to the electric motor unit, and the shaft member 752*b* is rotated in the clockwise direction. When the shutter plate interrupts the light beam of one of the photo-interrupters, the controlling circuit 680 acknowledges the enty into the enabled position ENB, and stops the driving current.

If the player depresses the push button switch again, the contrlling circuit supplies the driving current to the electric motor unit, and hte shaft member 752*b* is rotated in te counter clockwise direction. When the shutter plate interrupts the light beam of the other of the photo-interrupters, the controlling circuit 680 acknowledges the disabled position DSA, and stops the driving current.

Thus, the enabled position ENB and the disabled position DSA are defined by the non-contact sensors, and are not affected by undesirable force due to a physical contact.

Modifications

An electric motor unit may be directly coupled to a shaft member or coupled through a suitable transfer mechanism such as, for example, a reduction gear unit a belt and pulleys.

Figure 15:
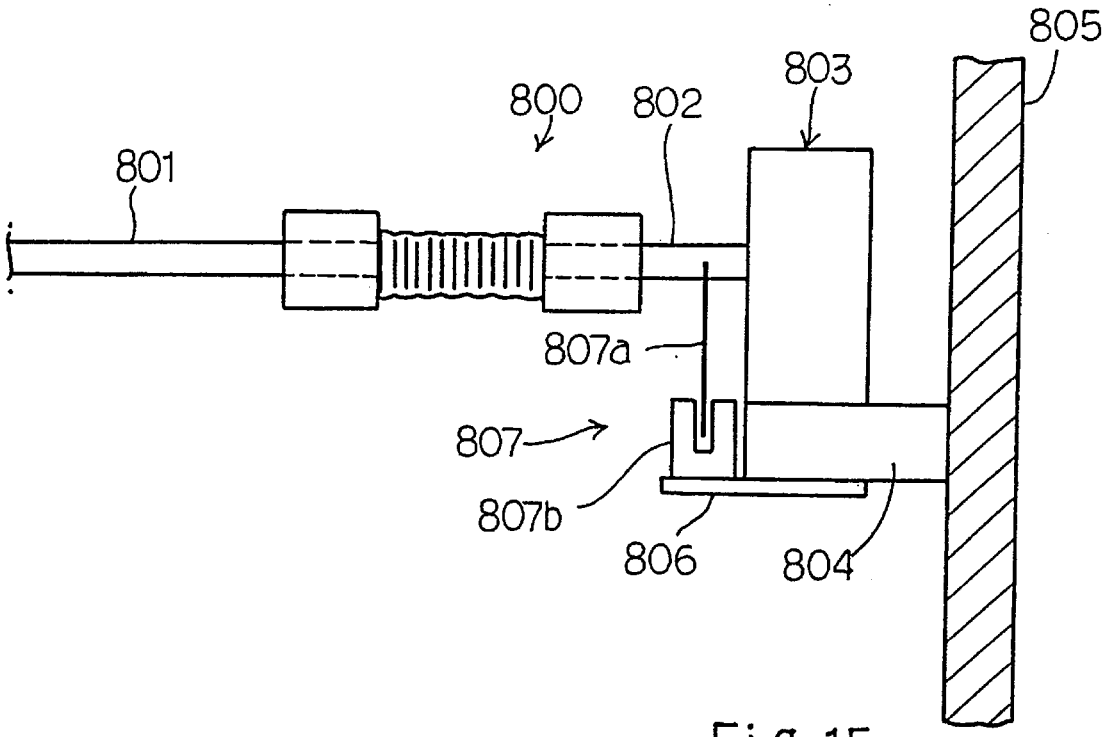
FIG. 15 is a side view showing a flexible coupling between an electric motor unit and a shaft member.

FIG. 15 illustrates a flexible coupling 800 between a shaft member and an output shaft 801 of an electric motor unit 803 mounted on a bracket 804 fixed to a side board 805. A print board 806 is attached to the bracket 804, and a position controller 807, i.e., a shutter plate 807*a* and photo-interrupters 807*b* are provided for the electric motor unit 803. The flexible coupling 800 absorbs mis-alignment between the output shaft 802 and the shaft member 801.

A keyboard musical instrument according to the present invention may produce both of the acoustic sounds and the electronic sounds, and a foot pedal may be used for the concurrent sound generation. Namely, if a player depresses the foot pedal, the electronic sound generating system is powered regardless of the position of the hammer stopper. On the other hand, if the foot pedal is laterally moved after the step-on, the controlling circuit supplies the driving current to the electric motor units so as to change the hammer stopper and the regulating button controller/the movable key bed.

A modification of the second embodiment may horizontally keep the movable key bed in the acoustic sound mode and decline it in the electronic sound mode. The turning axis of the movable key bed is provided in the vicinity of the keyboard, and listener hardly notices the declination of the front end of the movable key bed.

A modification of the first embodiment, if the electric motor unit stops the hammer stopper between the free position and the blocking position, a player can perform a music through soft sounds. In this instance, an additional photo-interrupter may be placed between the two photo-interrupters.

Figure 16:
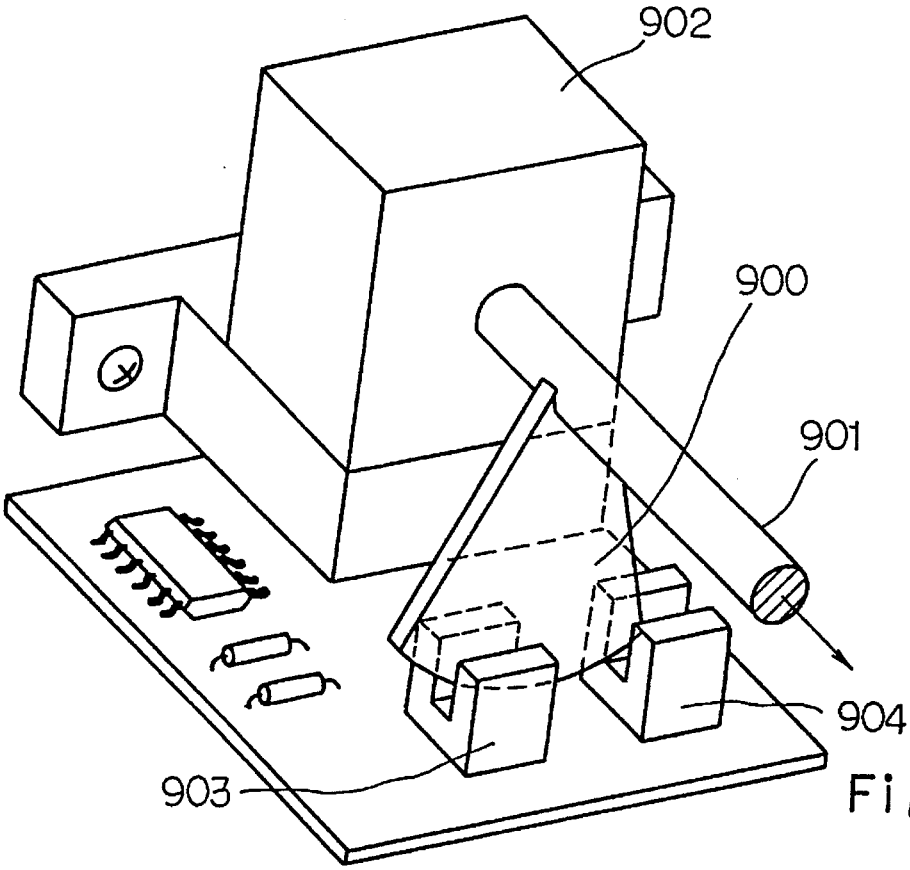
FIG. 16 is a perspective view showing another position controller.

A modification of the position controller may have a sector shutter plate 900 attached to an output shaft 901 of an electric motor unit 902 and photo-interrupters 903 and 904 as shown in FIG. 16. FIGS. 17A to 17D illustrate various relative positions of the sector shutter plate 900 with respect to the light beams of the photo-interrupters 903 and 904.

When the keyboard musical instrument is in the acoustic sound mode, the sector shutter plate 900 interrupts the light beam of the photo-interrupter 904, and the other photo-interrupter 903 establishes the optical path.

The sector shutter plate 900 is rotated in the clockwise direction, and the sector shutter plate 900 firsfly interrupts the light beam of the photo-interrupter 903. Thereafter, the sector shutter plate 900 allows the photo-interrupter 904 to establish the optical path, and the controller acknowledges the entry into the blocking position.

Similarly, if the sector shutter plate 900 is rotated in the counter clockwise direction, and the sector shutter plate 900 firstly interrupts the light beam of the photo-interrupter 904. Thereafter, the sector shutter plate 900 allows the photo-interrupter 903 to establish the optical path, and the controller acknowledges the entry into the free position.

Figure 17A:
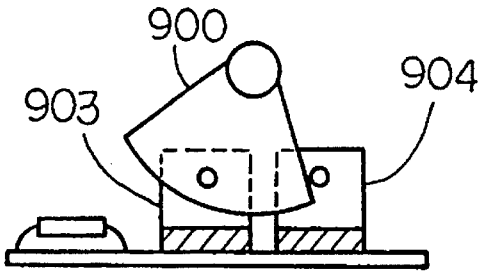
FIGS. 17A to 17D are views showing relative relation between a shutter plate and photo-interrupters of the position controllers.
Figure 17B:
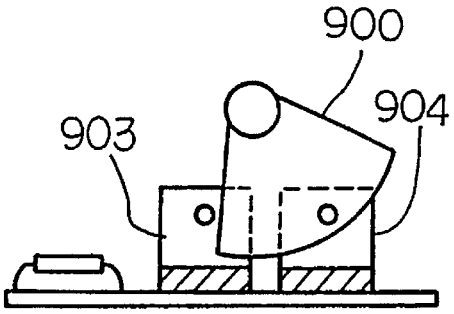
Figure 17C:
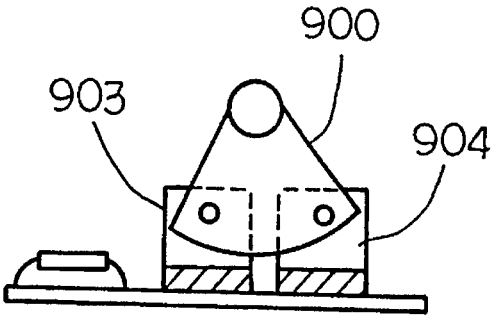
Figure 17D:
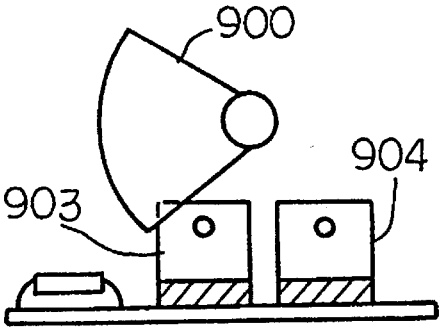

In this instance, the unusual state shown in FIGS. 4A and 4B are corresponding to the relative positions shown in FIGS. 17C and 17D.

Figure 18:
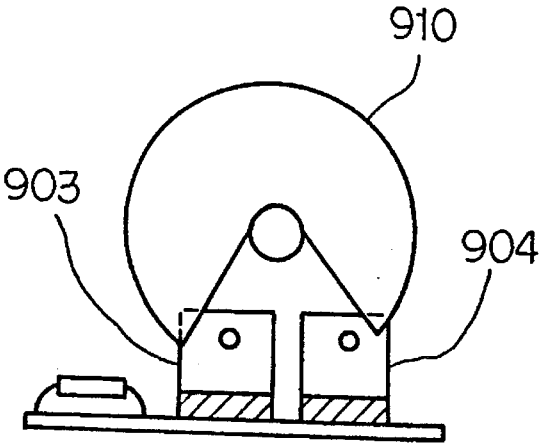
FIG. 18 is a view showing yet another position controller.

The sector shutter plate 900 may be replaced with a sector shutter plate 910 shown in FIG. 18.

Although particular embodiments of the present invention have been shown and described, it will be obvious those skilled in the art that various changes and modifications may be made without departing from the spirit and scope of the present invention.

First, a silent system of a keyboard musical instrument according to the present invention may include the hammer stopper only. That is, the regulating button controller is omitted from the keyboard musical instrument.

Solenoid-operated actuator units may be respectively provided under the black and white keys 101*a*/101*b* for an automatic playing, and the keyboard musical instrument equipped with the solenoid-operated actuator units may record and reproduce an original performance through the keyboard 101. In this instance, the keyboard musical instrument has the acoustic sound mode, the electronic sound mode and a recording/reproducing mode.

In the keyboard musical instrument equipped with the solenoid-operated actuator units, the positions of the hammer sensors may be changed between a recording mode and the electronic sound mode, because the final hammer velocity is strictly proportional to the intensity of hammer's impact.

The electronic sounds may selectively impart other timbres such as an organ, cembalo and celesta to the electronic sounds.

Although the photo-interrupters are used in the embodiments, another non-contact type position sensor may be installed in the keyboard musical instrument. The non-contact type position sensor may generate electric signals indicative of the free position Fp, the blocking position BP, the spaced position SP and the closed position CP through an electro-magnetic phenomenon, by way of example.

The electric motor units may be replaced with another kind of actuator such as, for example, a solenoid-operated actuator unit. The electronic tone generating unit 220 may supply the audio signal to a speaker system instead of or together with the headphone 230.

What is claimed is:

1. A keyboard musical instrument having at least an acoustic sound mode for generating acoustic sounds and an electronic sound mode for generating electronic sounds, comprising:

an acoustic piano including a keyboard having a plurality of turnable keys respectively assigned notes of a scale and selectively depressed by a player in both of said acoustic sound mode and said electronic sound mode, a plurality of string means for generating said acoustic sounds in said acoustic sound mode, a plurality of hammer assemblies respectively associated with said plurality of string means and driven for rotation for striking said plurality of string means in said acoustic sound mode, and a plurality of key action mechanisms functionally connected between said plurality of turnable keys and said plurality of hammer assemblies, respectively, and having respective jacks escaping from said plurality of hammer assemblies when said plurality of keys are depressed by said player;

an electronic sound generating system for generating said electronic sounds having the notes corresponding to the keys depressed by said player in said electronic sound mode; and a silent system including a hammer stopper having an interrupter changed between a free position and a blocking position, said interrupter entering into said free position in said acoustic sound mode so as to allow said plurality of hammer assemblies to strike said plurality of string means, said interrupter entering into said blocking position in said electronic sound mode so as to cause said plurality of hammer assemblies to rebound thereon before a strike at said plurality of string means, a first actuator means responsive to an instruction of said player so as to change said hammer stopper between said free position and said blocking position, and a first position controller having a first non-contact sensor operative to detect said interrupter upon an entry into said free position and a second non-contact sensor for detecting said interrupter upon an entry into said blocking position, said first actuator means stopping said interrupter when said first non-contact sensor and said second non-contact sensor report the entry into said free position and the entry into said blocking position.

2. The keyboard musical instrument as set forth in claim 1, in which said first non-contact sensor and said second non-contact sensor detect said entry into said free position and said entry into said blocking position by using respective light beams.

3. The keyboard musical instrument as set forth in claim 1, in which said first position controller further has a shutter plate fixed to said interrupter in such a manner as to interrupt the light beam of said first non-contact sensor at said free position and the light beam of said second non-contact sensor at said blocking position.

4. The keyboard musical instrument as set forth in claim 1, in which said plurality of key action mechanisms have respective regulating button mechanisms operative to cause said jacks to respectively escape from said plurality of hammer assemblies, said silent system further including a regulating button controller provided for said plurality of regulating button mechanisms and operative to change a gap between each of said plurality of regulating button mechanisms and associated one of said jacks between said acoustic sound mode and said electronic sound mode, said regulating button controller having a bracket member connected to said plurality of regulating button mechanisms, a second actuator means connected to said bracket member and responsive to said instruction of said player for changing said plurality of regulating button mechanisms between a spaced position and a closed position, said plurality of regulating button mechanisms staying at said spaced position in said acoustic sound mode and at said closed position in said electronic sound mode, and a second position controller having a third non-contact sensor operative to detect said regulating button mechanisms upon an entry into said spaced position and a fourth non-contact sensor for detecting said regulating button mechanisms upon an entry into said closed position, said second actuator means stopping said bracket member when said third non-contact sensor and said fourth non-contact sensor report the entry into said spaced position and the entry into said closed position.

5. The keyboard musical instrument as set forth in claim 4, in which said silent system further includes a controlling sub-system manipulated by said player for providing said instruction to said first and second actuator means.

6. The keyboard musical instrument as set forth in claim 1, in which said acoustic piano is a grand piano, and said plurality of strings are stretched over said plurality of hammer assemblies, said acoustic piano further comprising a key bed structure having a stationary key bed stationary with respect to said plurality of strings and a movable key bed movable between an upper position and a lower position with respect to said stationary key bed and supporting said keyboard, said plurality of key action mechanisms and said plurality of hammer assemblies, said silent system further including a lifter having a second actuator means, jack means provided between said stationary key bed and said movable key bed and actuated by said second actuator means so as to change said movable key bed between said upper position in said acoustic sound mode and said lower position in said electronic sound mode, and a second position controller having a third non-contact sensor operative to detect said movable key bed upon an entry into said upper position and a fourth non-contact sensor for detecting said movable key bed upon an entry into said lower position, said second actuator means stopping said movable key bed when said third non-contact sensor and said fourth non-contact sensor report the entry into said upper position and the entry into said lower position.

7. The keyboard musical instrument as set forth in claim 6, in which said acoustic piano further comprises a plurality of damper mechanisms respectively associated with said plurality of strings and moved by said plurality of keys so as to leave said plurality of strings before said plurality of hammer assemblies strike the associated strings in said acoustic sound mode, said silent system further including a gap regulator having a motion transferring means linked with said movable key bed, and a plurality of spacers functionally connected to said motion transferring means and moved out of trajectories of said plurality of keys in said acoustic sound mode and into said trajectories of said plurality of keys in said electronic sound mode for transferring motions of said plurality of keys to said plurality of damper mechanisms, respectively.

8. The keyboard musical instrument as set forth in claim 6, in which said acoustic piano further comprises a plurality of damper mechanisms respectively associated with said plurality of strings and moved by said plurality of keys so as to leave said plurality of strings before said plurality of hammer assemblies strike the associated strings in said acoustic sound mode, said silent system further including a gap regulator having a third actuator means responsive to said instruction, a plurality of spacers functionally connected to said third actuator means so as to be changed between a shunt position and a make-up position, said plurality of spacers in said shunt position being out of trajectories of said plurality of keys in said acoustic sound mode, said plurality of spacers in said make-up position being in said trajectories of said plurality of keys in said electronic sound mode for transferring motions of said plurality of keys to said plurality of damper mechanisms, respectively, and a third position controller having a fifth non-contact sensor operative to detect said plurality of spacers upon an entry into said shunt position and a sixth non-contact sensor for detecting said plurality of spacers upon an entry into said make-up position, said third actuator means stopping said plurality of spacers when said fifth non-contact sensor and said sixth non-contact sensor report the entry into said shunt position and the entry into said make-up position.

9. The keyboard musical instrument as set forth in claim 8, in which said silent system further includes a controlling sub-system manipulated by said player for providing said instruction to said first, second and third actuator means.

10. The keyboard musical instrument as set forth in claim 9, in which said controlling sub-system starts said second actuator means earlier than said third actuator means when said instruction is indicative of the change from said acoustic sound mode to said electronic sound mode, said controlling sub-system starting said third actuator means earlier than said second actuator means when said instruction is indicative of the change from said electronic sound mode to said acoustic sound mode.

11. The keyboard musical instrument as set forth in claim 1, further comprising a muting system changed between an enabled position and a disabled position during said acoustic sound mode, and associated with said jacks so as to decrease a kinetic energy imparted to said plurality of hammer assemblies upon escapes of said jacks therefrom.

12. The keyboard musical instrument as set forth in claim 11, said acoustic piano further includes regulating mechanisms with which toes of said jacks are brought into contact for escaping from said hammer assemblies, said muting system including an auxiliary toes respectively provided on said jacks closer to turning axes of said jacks than said toes, and auxiliary regulating button mechanisms changed between said enabled position and said disabled position, said toes being brought into contact with said regulating button mechanisms without a contact between said auxiliary toes and said auxiliary regulating button mechanisms in said disabled position, said auxiliary toes being brought into contact with said auxiliary regulating buttons in said enabled position so that said jacks turn around said turning axes faster.

* * * * *